US009950348B2

(12) United States Patent
Zink

(10) Patent No.: US 9,950,348 B2
(45) Date of Patent: Apr. 24, 2018

(54) FLEXIBLE CLEANING LANCE POSITIONER GUIDE APPARATUS

(71) Applicant: STONEAGE, INC., Durango, CO (US)

(72) Inventor: Gerald P. Zink, Durango, CO (US)

(73) Assignee: STONEAGE, INC., Durango, CO (US)

( * ) Notice: Subject to any disclaimer, the term of this patent is extended or adjusted under 35 U.S.C. 154(b) by 290 days.

(21) Appl. No.: 14/873,873

(22) Filed: Oct. 2, 2015

(65) Prior Publication Data

US 2016/0096202 A1 Apr. 7, 2016

Related U.S. Application Data

(60) Provisional application No. 62/120,691, filed on Feb. 25, 2015, provisional application No. 62/060,162, filed on Oct. 6, 2014.

(51) Int. Cl.
*B08B 9/04* (2006.01)
*B08B 3/02* (2006.01)
(Continued)

(52) U.S. Cl.
CPC ..... *B08B 3/02* (2013.01); *B05B 13/0636* (2013.01); *B08B 9/045* (2013.01); *B08B 9/0433* (2013.01);
(Continued)

(58) Field of Classification Search
CPC . F28G 1/16; F28G 1/163; F28G 1/166; F28G 3/16; F28G 3/163; F28G 3/166; F28G 9/00; F28G 9/005; F28G 15/00; F28G 15/003; F28G 15/02; F28G 15/04; B08B 9/04; B08B 9/043; B08B 9/0433; B08B 9/045; B08B 9/047; B08B 9/0813; B08B 9/093; B08B 9/0933; B08B 9/0936; F22B 37/48; F22B 37/483; F22B 37/52
See application file for complete search history.

(56) References Cited

U.S. PATENT DOCUMENTS 3,060,972 A 10/1962 Sheldon ..... 138/120
3,077,314 A 2/1963 Caperton ..... 242/54
(Continued)

FOREIGN PATENT DOCUMENTS

EP 0341953 11/1989

OTHER PUBLICATIONS

International Search Report and Written Opinion, dated Dec. 30, 2015, from corresponding International Patent Application No. PCT/US2015/053742.

*Primary Examiner* — David G Cormier
(74) *Attorney, Agent, or Firm* — Greenberg Traurig, LLP

(57) ABSTRACT

A flexible high pressure fluid cleaning lance drive apparatus includes a guide rail having a longitudinal axis adapted to be positioned within a boiler water box and aligned in a fixed position with respect to a central axis of the water box. A tractor drive module is mounted on the guide rail, a helix clad high pressure fluid hose drive module is mounted on the guide rail operable to propel a flexible lance helix clad hose through the drive module along an axis parallel to the guide rail longitudinal axis, and a right angle guide rotator module is mounted on the guide rail and connected to the tractor module for positioning a rotatable high pressure nozzle carried by the helix clad hose within a guide tube attached to the rotator module.

17 Claims, 19 Drawing Sheets

(51) Int. Cl.

| | |
|---|---|
| ***B08B 9/045*** | (2006.01) |
| ***B08B 9/043*** | (2006.01) |
| ***F28G 1/16*** | (2006.01) |
| ***B65H 75/42*** | (2006.01) |
| ***B05B 13/06*** | (2006.01) |
| ***F28G 15/00*** | (2006.01) |
| ***F28G 15/02*** | (2006.01) |
| ***F28G 15/04*** | (2006.01) |
| ***F22B 37/54*** | (2006.01) |

(52) U.S. Cl.

CPC ..... *B65H 75/42* (2013.01); *F22B 37/54* (2013.01); *F28G 1/163* (2013.01); *F28G 15/003* (2013.01); *F28G 15/02* (2013.01); *F28G 15/04* (2013.01); *B08B 3/024* (2013.01); *B65H 2701/33* (2013.01)

(56) References Cited

U.S. PATENT DOCUMENTS

| | | | | |
|---|---|---|---|---|
| 3,370,599 | A | 2/1968 | Ciaccio | 134/167 |
| 4,743,175 | A | 5/1988 | Gilmore | 417/361 |
| 5,031,263 | A | 7/1991 | Babb et al. | 15/104.33 |
| 5,036,871 | A | 8/1991 | Ruggieri et al. | 134/167 R |
| 5,065,703 | A | 11/1991 | Lee | 122/382 |
| 5,107,873 | A * | 4/1992 | Clinger | B08B 9/0936 134/167 R |
| 5,184,636 | A | 2/1993 | van der Woude | 134/167 C |
| 5,251,611 | A | 10/1993 | Zehel et al. | 128/4 |
| 5,322,080 | A | 6/1994 | Rankin | 134/167 |
| 5,564,371 | A | 10/1996 | Ashton et al. | 122/392 |
| 5,570,660 | A | 11/1996 | Vandenberg | 122/379 |
| 5,782,209 | A | 7/1998 | Vandenberg | 122/379 |
| 5,933,903 | A | 8/1999 | Irwin | 15/104.33 |
| 6,283,069 | B1 | 9/2001 | Bude et al. | 122/379 |
| 6,360,757 | B1 | 3/2002 | Bohrer | 134/113 |
| 6,543,392 | B1 | 4/2003 | Ashton, III et al. | 122/392 |
| 6,626,195 | B1 | 9/2003 | Garman et al. | 134/104.1 |
| 6,672,257 | B1 | 1/2004 | Ashton, III et al. | 122/379 |
| 7,178,534 | B2 | 2/2007 | Garman et al. | 134/167 |
| 7,464,670 | B2 | 12/2008 | Hermamdez et al. | 122/379 |
| 7,530,363 | B2 | 5/2009 | Garman | 134/167 |
| 8,048,234 | B2 | 11/2011 | Jacquinet | 134/22.12 |
| 8,757,104 | B2 | 6/2014 | Hawkins et al. | 122/379 |
| 2009/0211612 | A1 | 8/2009 | Athanassiu et al. | 134/54 |
| 2012/0103368 | A1 | 5/2012 | Gromes, Sr. | 134/22.12 |

* cited by examiner

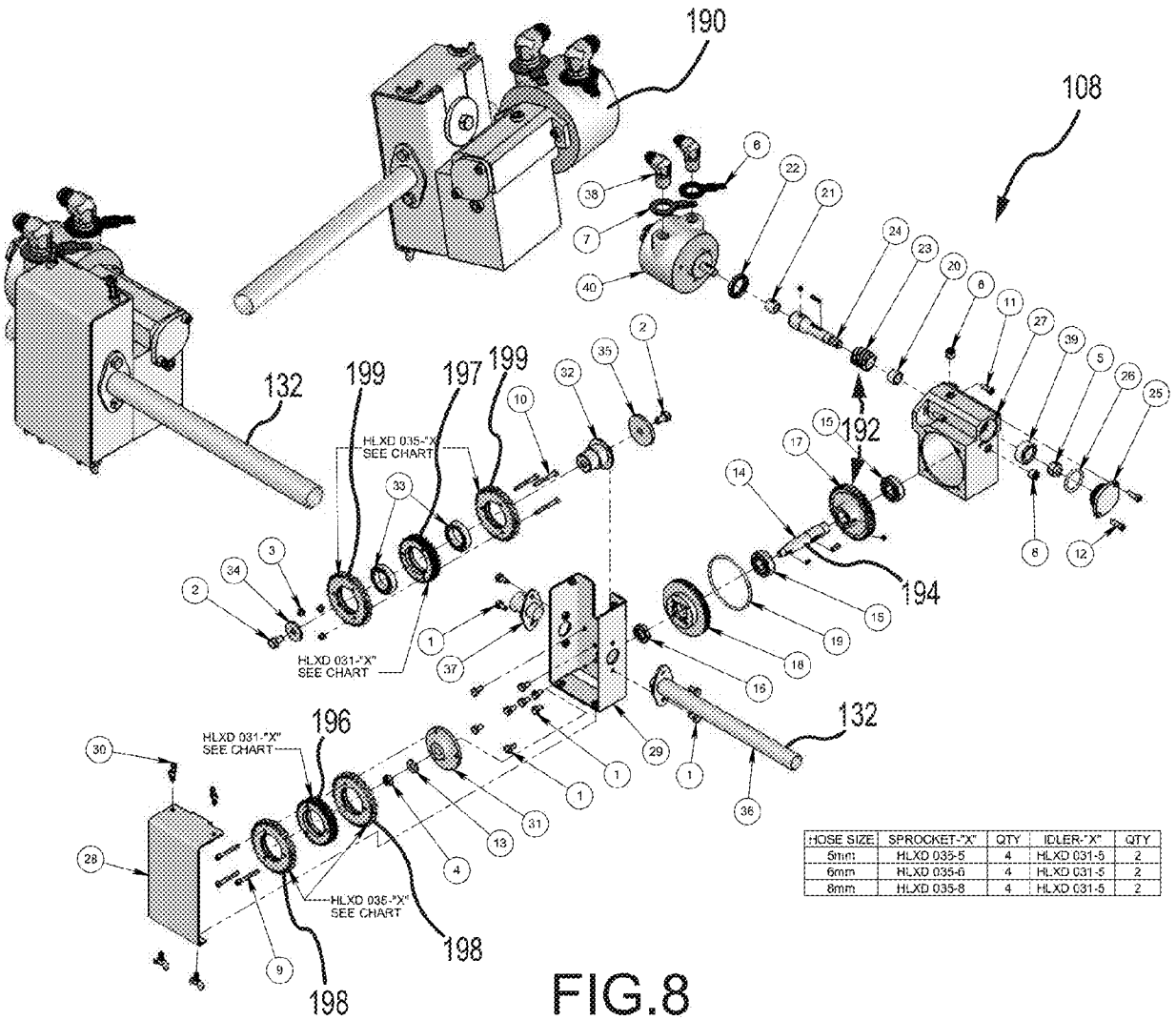

| HOSE SIZE | SPROCKET-"X" | QTY | IDLER-"X" | QTY |
|---|---|---|---|---|
| 5mm | HLXD 035-5 | 4 | HLXD 031-5 | 2 |
| 6mm | HLXD 035-6 | 4 | HLXD 031-5 | 2 |
| 8mm | HLXD 035-8 | 4 | HLXD 031-5 | 2 |

FIG.8

| ITEM NO. | PART NUMBER | QTY |
|---|---|---|
| 1 | GB 325-02 Bolt, Hex .25-20 x .50 SS | 12 |
| 2 | GB 337-025 Bolt, Hex .37-16 x .62 SS | 2 |
| 3 | GN 319-L-24 Nylok Nut SS | 3 |
| 4 | GN 337-L Nylok Nut SS Thin | 1 |
| 5 | GN 350-L Nylok Nut SS | 1 |
| 6 | GP 010-BK Black Plastic ID Washer P8 | 1 |
| 7 | GP 010-P Purple Plastic ID Washer P8 | 1 |
| 8 | GP 025-P4SS Hex Socket Plug | 2 |
| 9 | GS 319-065 SHCS .19-24 x 1.63 SS | 3 |
| 10 | GS 319-07 SHCS .19-24 x 1.75 SS | 3 |
| 11 | GS 325-025 SHCS .25-20 x .62 SS | 2 |
| 12 | GS 325-03 SHCS .25-20 x .75 SS (TB 050) | 2 |
| 13 | GW 337-F Flat Washer SS | 1 |
| 14 | HLXD 001 Axle, Output | 1 |
| 15 | HLXD 002 Bearing, Output | 2 |
| 16 | HLXD 003 Seal, Output | 1 |
| 17 | HLXD 004 Worm Gear | 1 |
| 18 | HLXD 005 Bulkhead, Output | 1 |
| 19 | HLXD 006 O-Ring, Output | 1 |
| 20 | HLXD 011 Spacer | 1 |
| 21 | HLXD 012 Keyed Bushing | 1 |
| 22 | HLXD 013 Seal, Input | 1 |
| 23 | HLXD 014 Worm, Input | 1 |
| 24 | HLXD 015 Axle, Input | 1 |
| 25 | HLXD 016 Worm Cap, Input | 1 |
| 26 | HLXD 017 Cap O-Ring, Input | 1 |
| 27 | HLXD 018 Main Gearbox | 1 |
| 28 | HLXD 019 Cover | 1 |
| 29 | HLXD 020 Gear Box Weldment | 1 |
| 30 | HLXD 021 Stud, Wing | 4 |
| 31 | HLXD 028 Sprocket Drive Flange | 1 |
| 32 | HLXD 040 Idler Axle | 1 |
| 33 | HLXD 041 Bearing, Idler Axle | 2 |
| 34 | HLXD 042 Front Washer | 1 |
| 35 | HLXD 043 Back Washer | 1 |
| 36 | HLXD 050 Snout Tube Weldment, Long | 1 |
| 37 | HLXD 051 Snout Tube Weldment, Short | 1 |
| 38 | HRS 873 Fitting 90 Deg P3J8 | 2 |
| 39 | RJ 007 Bearing 7202 | 1 |
| 40 | SG 055 Air Motor | 1 |

| ITEM NO. | PART NUMBER | QTY. |
|---|---|---|
| 1 | BC 009 Bearing | 2 |
| 2 | BR 052-2.0-90 Axle-Zerk | 3 |
| 3 | BR 055 Roller Assy | 3 |
| 4 | GN 337-L Nylok Nut SS | 1 |
| 5 | GN 350-L-20 Nylok Nut SS | 1 |
| 6 | GP 010-B Blue Plastic ID Washer P8 | 1 |
| 7 | GP 010-Y Yellow Plastic ID Washer P8 | 1 |
| 8 | GP 025-P4SS Hex Socket Plug | 1 |
| 9 | GS 325-03 SHCS .25-20 x .75 SS (TB 050) | 4 |
| 10 | GS 325-16 SHCS .25-20 x 4.00 SS | 2 |
| 11 | GS 331-025 SHCS .31-18 x .62 SS | 1 |
| 12 | GW 331-F Flat Washer | 1 |
| 13 | HLXD 012 Keyed Bushing | 1 |
| 14 | HLXD 013 Seal, Input | 1 |
| 15 | HLXD 017 Cap O-Ring, Input | 1 |
| 16 | HLXT 001 Axle, Output | 1 |
| 17 | HLXT 002 Spur Gear, Output | 1 |
| 18 | HLXT 003 Bushing, Output | 1 |
| 19 | HLXT 004 34 x 48 x 7 TC Seal, Final | 1 |
| 20 | HLXT 005 Worm Gear, Output | 2 |
| 21 | HLXT 006 Spacer, Output | 2 |
| 22 | HLXT 007 20 x 36 x 7 TC Seal, Final | 1 |
| 23 | HLXT 008 Bellville Washer | 2 |
| 24 | HLXT 009 Seal Sleeve, Output | 1 |
| 25 | HLXT 010 O-Ring, Final | 2 |
| 26 | HLXT 015 Axle, Input | 1 |
| 27 | HLXT 016 Worm, Mid-Main | 2 |
| 28 | HLXT 017 Spacer, Input | 1 |
| 29 | HLXT 018 Worm Cap, Input | 1 |
| 30 | HLXT 021 Axle, Mid | 1 |
| 31 | HLXT 022 Gear Spacer, Mid | 1 |
| 32 | HLXT 023 Worm Cap, Mid | 1 |
| 33 | HLXT 024 O-Ring, Mid | 1 |
| 34 | HLXT 025 Wave Spring, Mid | 3 |
| 35 | HLXT 030 Housing | 1 |
| 36 | HLXT 031 Lower Chassis Clamp | 1 |
| 37 | HLXT 032 Upper Chassis Clamp | 1 |
| 38 | HLXT 033 .50-13 Threaded Rod | 2 |
| 39 | HLXT 037 Bar Knob-.38 | 2 |
| 40 | HLXT 038 Bar Knob-.50 | 2 |
| 41 | HLXT 039 .37-16-2.5 THREADED ROD | 2 |
| 42 | HLXT 040-16mm Ball Stud | 1 |
| 43 | HLXT 041-16mm Ball Socket | 1 |
| 44 | HRS 573 Fitting 90 Deg P8/8 | 2 |
| 45 | RJ 009 Bearing | 3 |
| 46 | SG 055 Air Motor | 1 |

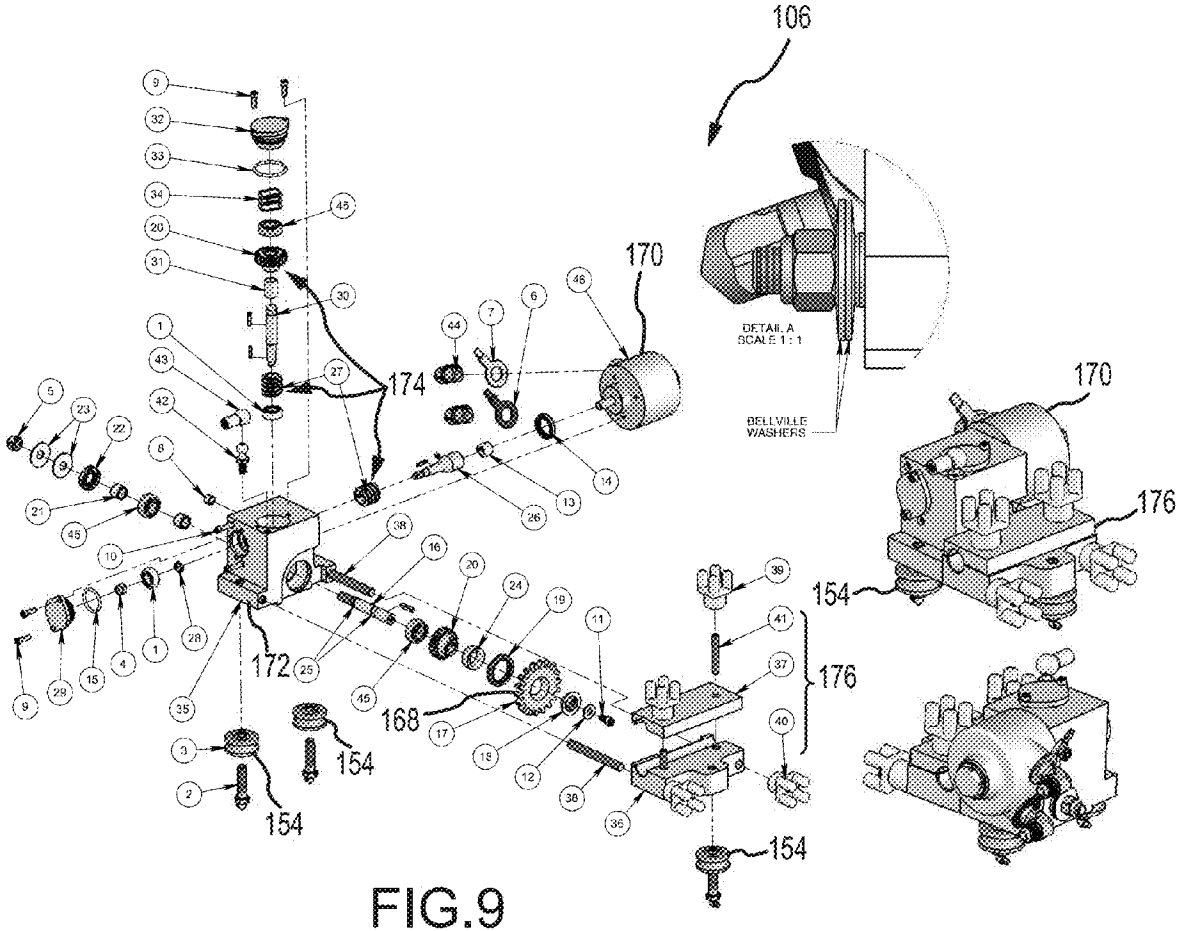

FIG.9

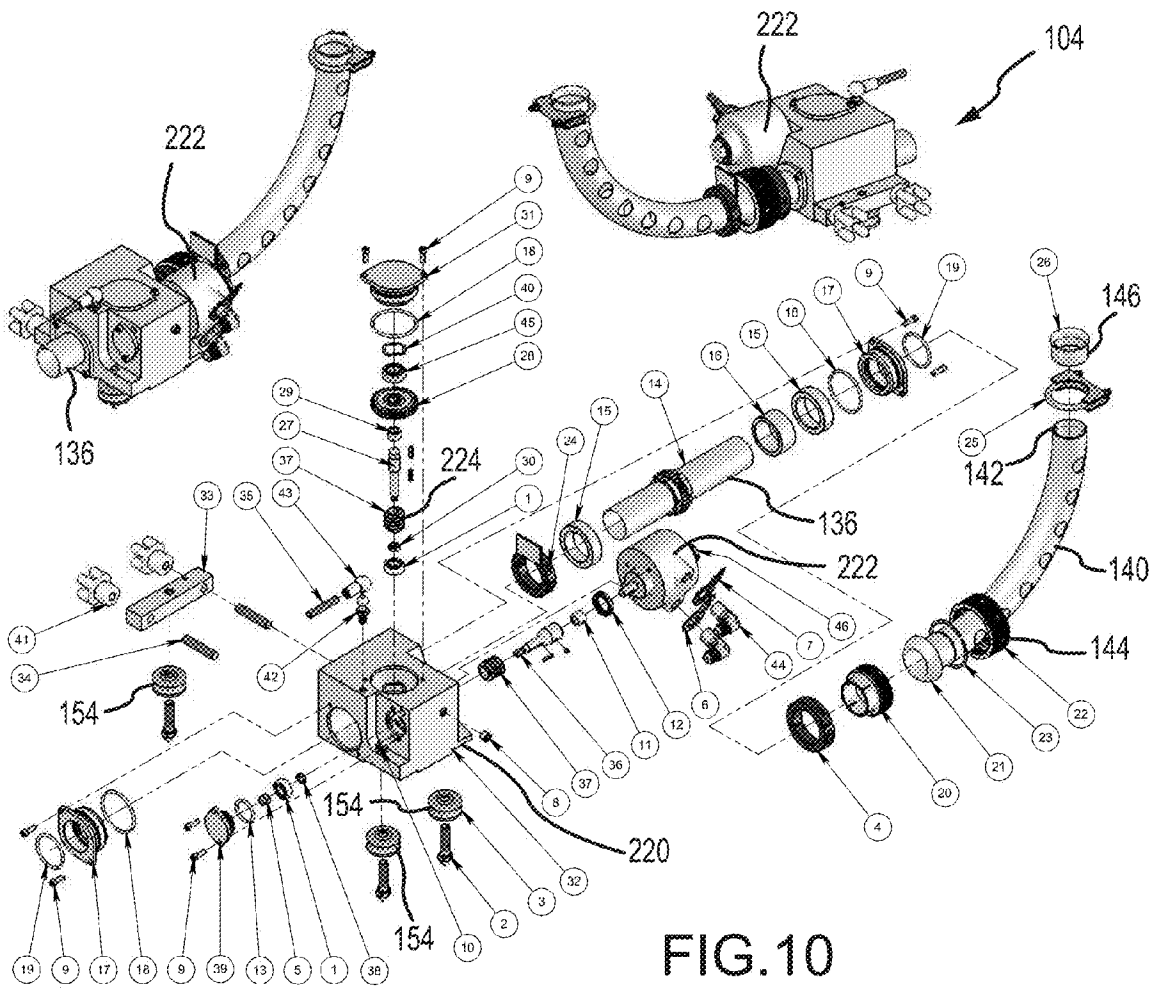

FIG.10

| # | PART NUMBER | QTY |
|---|---|---|
| 1 | BC 009 Bearing | 2 |
| 2 | BR 052-2.0-50 Axle-Zerk | 3 |
| 3 | BR 055 Roller Assy | 3 |
| 4 | GC SP-36-F Collar Assy | 1 |
| 5 | GN 337-L Nylok Nut SS | 1 |
| 6 | GP 010-G Green Plastic ID Washer P8 | 1 |
| 7 | GP 010-R Red Plastic ID Washer P8 | 1 |
| 8 | GP 025-P4SS Hex Socket Plug | 1 |
| 9 | GS 325-03 SHCS .25-20 x .75 SS (TB 050) | 8 |
| 10 | GS 325-16 SHCS .25-20 x 4.00 SS | 2 |
| 11 | HLXD 012 Keyed Bushing | 1 |
| 12 | HLXD 013 Seal, Input | 1 |
| 13 | HLXD 017 Cap O-Ring, Input | 1 |
| 14 | HLXR 001 Drive Tube, Output Weldment | 1 |
| 15 | HLXR 004 Bushing, Output | 2 |
| 16 | HLXR 005 Spacer, Output | 1 |
| 17 | HLXR 006 Worm Cap, Output | 2 |
| 18 | HLXR 007 O-Ring Outer, Final | 3 |
| 19 | HLXR 008 O-Ring Inner, Final | 2 |
| 20 | HLXR 009 Pivot Collet | 1 |
| 21 | HLXR 010 Elbow, Weldment | 1 |
| 22 | HLXR 011 Knurled Nut | 1 |
| 23 | HLXR 012 Wave Spring, Elbow | 1 |
| 24 | HLXR 013 Stop, Elbow | 1 |
| 25 | HLXR 014 U-Bolt Clamp | 1 |
| 26 | HLXR 015-XX Flare, Modified | 1 |
| 27 | HLXR 021 Axle Drive, Mid | 1 |
| 28 | HLXR 022 Worm Gear, Mid | 1 |
| 29 | HLXR 023 Spacer Upper, Mid | 1 |
| 30 | HLXR 024 Spacer Lower, Mid | 1 |
| 31 | HLXR 025 Worm Cap, Mid | 1 |
| 32 | HLXR 030 Housing | 1 |
| 33 | HLXR 031 Split Clamp | 1 |
| 34 | HLXR 033 .50-13 Threaded Rod SS | 2 |
| 35 | HLXR 035 M10X1.5 Threaded Rod SS | 1 |
| 36 | HLXT 015 Axle, Input | 1 |
| 37 | HLXT 016 Worm, Mid-Main | 2 |
| 38 | HLXT 017 Spacer, Input | 1 |
| 39 | HLXT 018 Worm Cap, Input | 1 |
| 40 | HLXT 025 Wave Spring, Mid | 3 |
| 41 | HLXT 038 Bar Knob- 50 | 2 |
| 42 | HLXT 040-16mm Ball Stud | 1 |
| 43 | HLXT 041-16mm Ball Socket | 1 |
| 44 | HRS 573 Fitting 90 Deg P8J8 | 2 |
| 45 | RJ 009 Bearing | 1 |
| 46 | SG 065 Air Motor | 1 |

FLEXIBLE CLEANING LANCE POSITIONER GUIDE APPARATUS

CROSS REFERENCE TO RELATED APPLICATIONS

This application claims the benefit of priority of U.S. Provisional Patent Application Ser. No. 62/060,162, entitled Flexible Cleaning Lance Positioner Guide Apparatus, filed Oct. 6, 2014, and U.S. Provisional Patent Application Ser. No. 62/120,691, filed Feb. 25, 2015, entitled Flexible Cleaning Lance Positioner Guide and Hose Rotator Apparatus, the content of each of which is hereby incorporated by reference in its entirety.

BACKGROUND OF THE DISCLOSURE

The present disclosure is directed to high pressure fluid rotary nozzle cleaning systems.

Conventional lance positioner guides are rigid frame structures that can be assembled adjacent a heat exchanger once the tube sheet flange cover has been removed. These work well when the heat exchanger access cover provides a straight access to the tubes, e.g., directly reveals the tube sheet. However, such structures cannot be used to position a flexible lance or rotary nozzle within a tube in a heat exchanger arrangement that has tube penetrations that are offset from the access cover such as in a package boiler heat exchanger water box. For such tube configurations it is extremely difficult to guide a high pressure nozzle into such tubes.

SUMMARY OF THE DISCLOSURE

The present disclosure directly addresses such needs. One of many examples of such configurations is a package boiler heat exchanger water box. An embodiment in accordance with the present disclosure for use, for example, in a package boiler water box is a flexible high pressure fluid cleaning lance positioning and drive apparatus. This apparatus includes a straight guide rail having a longitudinal axis adapted to be positioned within a boiler water box and aligned in a fixed position with respect to a central axis of the water box. A tractor drive module is mounted on the guide rail. A helix clad high pressure fluid hose drive module also mounted on the guide rail is operable to propel a flexible lance helix clad hose through the drive module along an axis parallel to the guide rail longitudinal axis. An elbow right angle guide rotator module is mounted on the guide rail and connected to the tractor module for positioning a rotatable high pressure nozzle carried by the helix clad hose within a guide tube attached to the rotator module so as to be in registry with a tubular object to be cleaned and guiding the nozzle into the tubular object. The tractor drive module is preferably connected to the hose drive module by a conduit for carrying the helix clad hose therein. The apparatus preferably further includes a hose take-up drum module mounted on the guide rail and spaced from the hose drive module that is operable to collect and dispense helix clad hose from and to the hose drive module.

An exemplary tubular object to be cleaned might be a package boiler tube that extends in a radial direction from a heat exchanger water box axis, parallel to the guide rail axis. In such an application, the rotator module includes a curved tube having one end aligned with the hose drive module and an open end directed at a right angle from the guide rail axis. The rotator drive motor is connected to the curved tube for rotating the curved tube about the one end, and thus about the axis of the water box so that the curved guide tube may be remotely aligned with its open end in registry with a selected one of the boiler tubes radiating from the water box of the boiler.

Further features, advantages and characteristics of the embodiments of this disclosure will be apparent from reading the following detailed description when taken in conjunction with the drawing figures.

DESCRIPTION OF THE DRAWINGS

FIG. 8 is schematic exploded assembly drawing of an exemplary helix hose drive module shown in FIGS. 1 and 2.

FIG. 9 is a separate exploded assembly drawing of an exemplary tractor drive module shown in FIGS. 1 and 2.

FIG. 10 is a schematic exploded assembly drawing of an exemplary rotator drive module shown in FIGS. 1 and 2.

DETAILED DESCRIPTION

Figure 1:
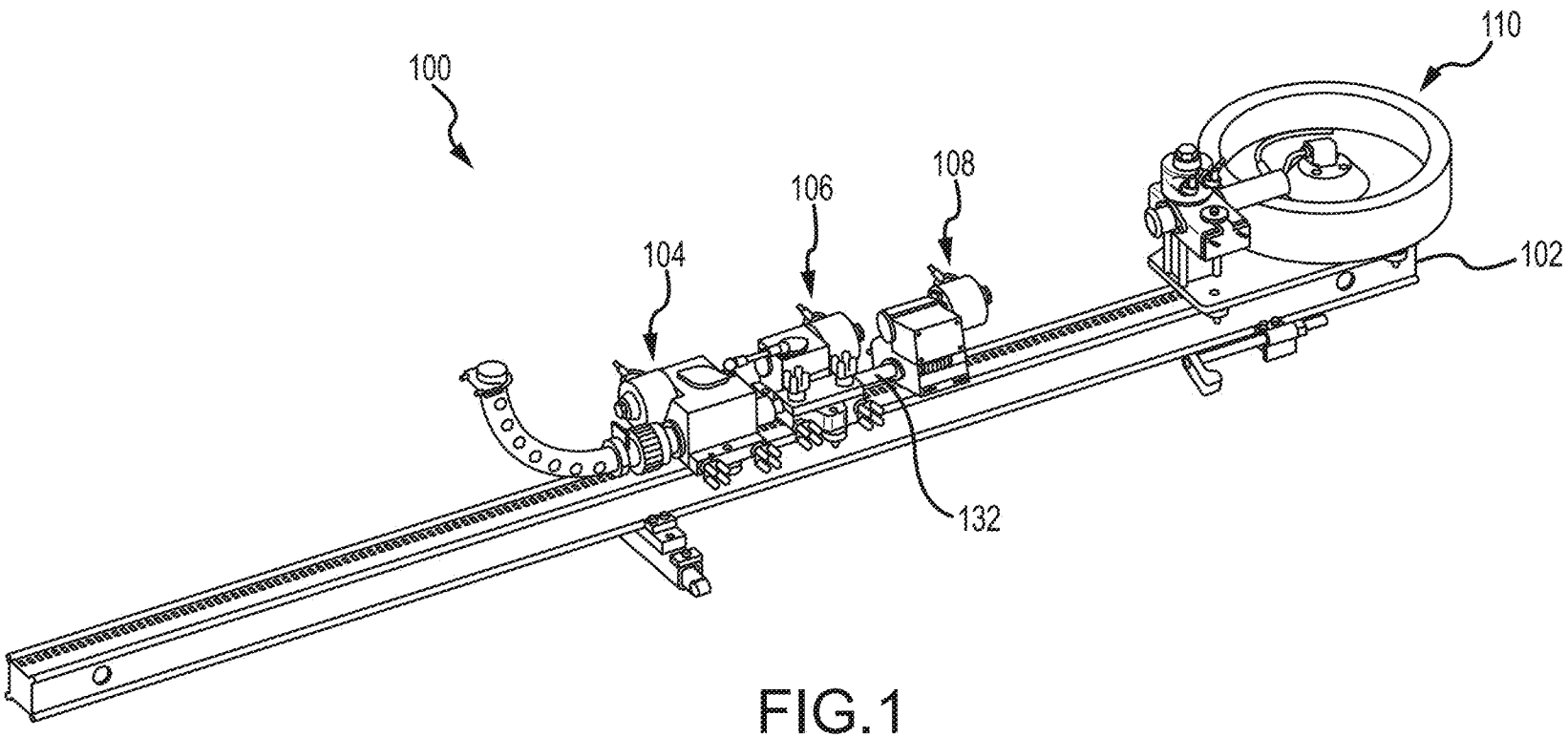
FIG. 1 is a perspective view of an exemplary embodiment of a flexible high pressure nozzle positioner drive apparatus in accordance with the present disclosure.

An exemplary apparatus 100 in accordance with the present disclosure is shown in a perspective view in FIG. 1.

The apparatus 100 includes a rigid guide rail 102 upon which is mounted a right angle guide tube rotator module 104, a tractor drive module 106, a helix clad hose drive module 108, and a high pressure helix clad hose take-up module 110, which is connectable to a high pressure fluid source (not shown). Each of these modules 104, 106, 108, and 110 includes a pneumatic or hydraulic motor that is remotely operated by an operator from a remote control console (not shown).

Figure 7:
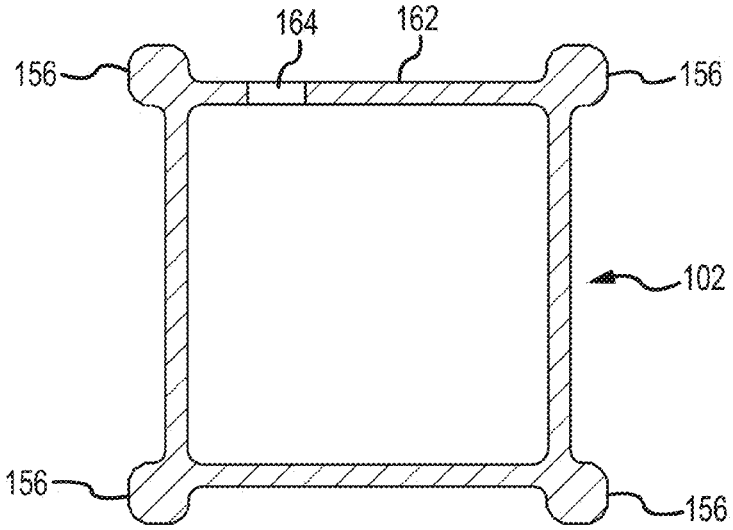
FIG. 7 is a cross sectional view of the support rail of the apparatus in accordance with the present disclosure.

The guide rail 102 is an elongated generally rigid body having preferably, a generally rectangular, preferably square box cross sectional shape as shown in FIG. 7. This box shape rail 102 includes a top wall 162 defined by protruding ribs 156 at each corner of the top wall 162 that operate as guide tracks for the several modules 104, 106, and 108 of the apparatus 100. Each of the other corners of the rail 102 may also have protruding ribs 156. This rail 102 may be inverted to suspend the modules 104, 106, and 108 beneath the rail 102 in certain applications described further below. The take-up module 110 is preferably held stationary, and may also be mounted on the rail 102.

Figure 2:
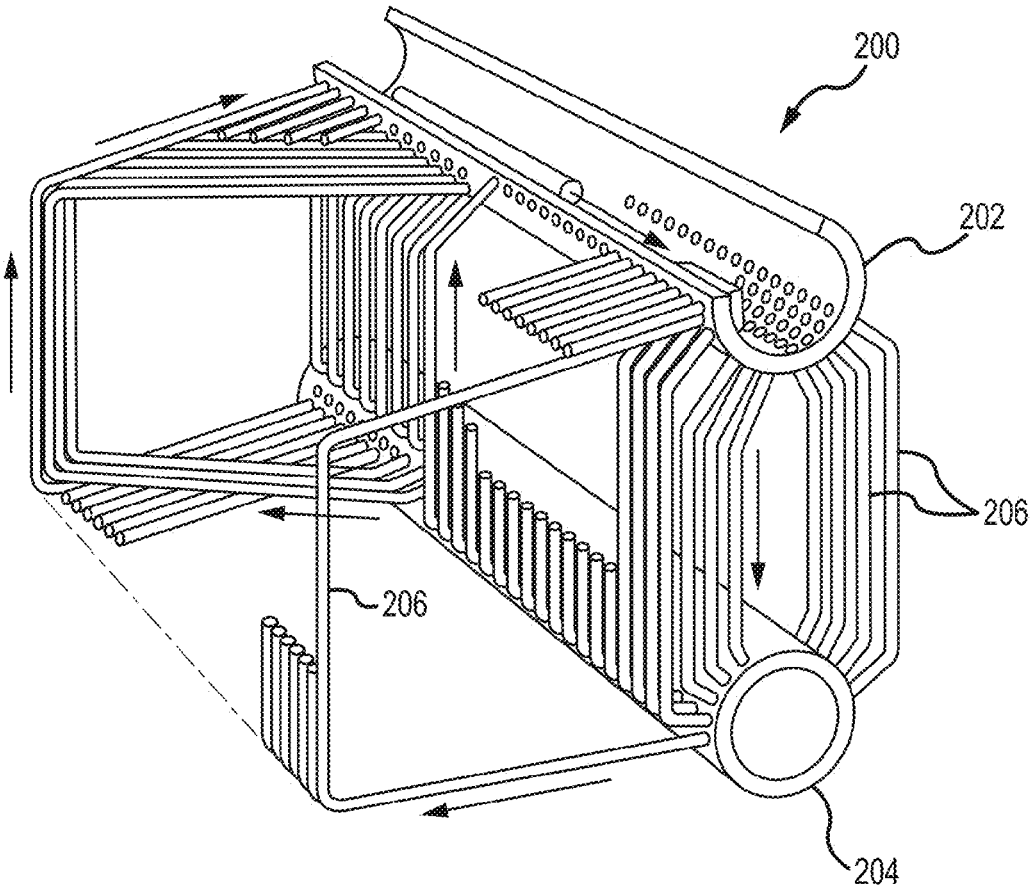
FIG. 2 is a schematic perspective diagram of one exemplary water box and tube arrangement in a package boiler.

In a first application of the apparatus in accordance with the present disclosure, the tube arrangement in an exemplary package boiler 200 is diagrammed in FIG. 2. In this first embodiment shown and described herein, the guide rail 102 is designed to be inserted into an upper steam/water box 202 or lower heat exchanger water box 204 of the package boiler 200. A plurality of tubes 206 radially extend out of the side of each water box 202 and 204 and pass around the furnace box of the boiler such that water can pass out of the lower water box 204, around the furnace box of the package boiler 200 to the steam/water box 202 and back again. Each of the tubes 206 that span between the two water boxes 202 and 204 pass into the water boxes radially relative to the longitudinal axis of the water boxes 202 and 204. Some of these tubes 206 extend around the furnace walls of the boiler 200. Others pass relatively directly between the boxes 202 and 204. Typically these water boxes have a 2-3 foot inner diameter, and each typically has an end access manway that has an elliptical opening about 12 by 16 inches.

Figure 4:
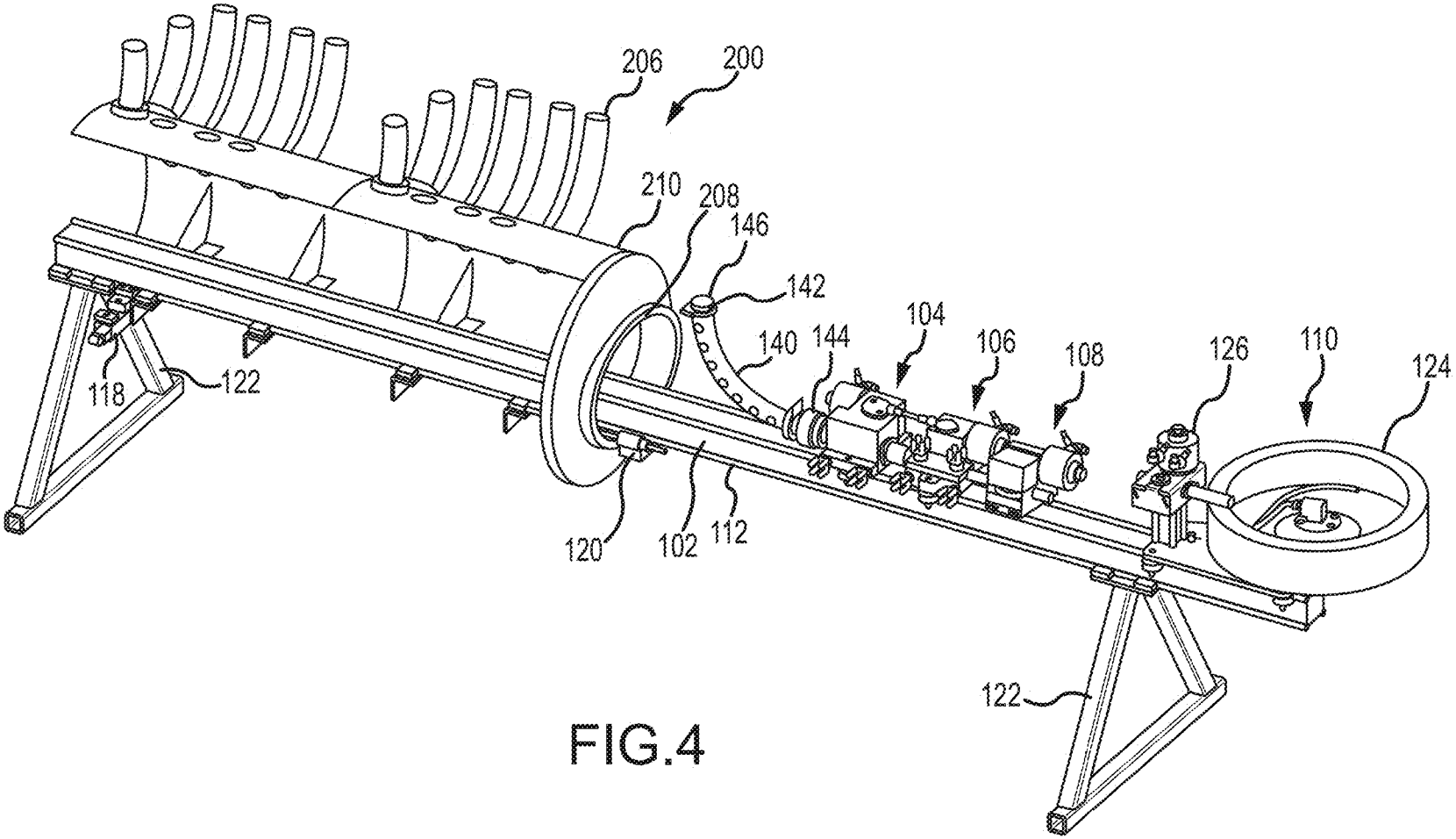
FIG. 4 is a perspective view of the drive apparatus shown in FIG. 3 aligned with a mock-up of a package boiler water box.
Figure 5:
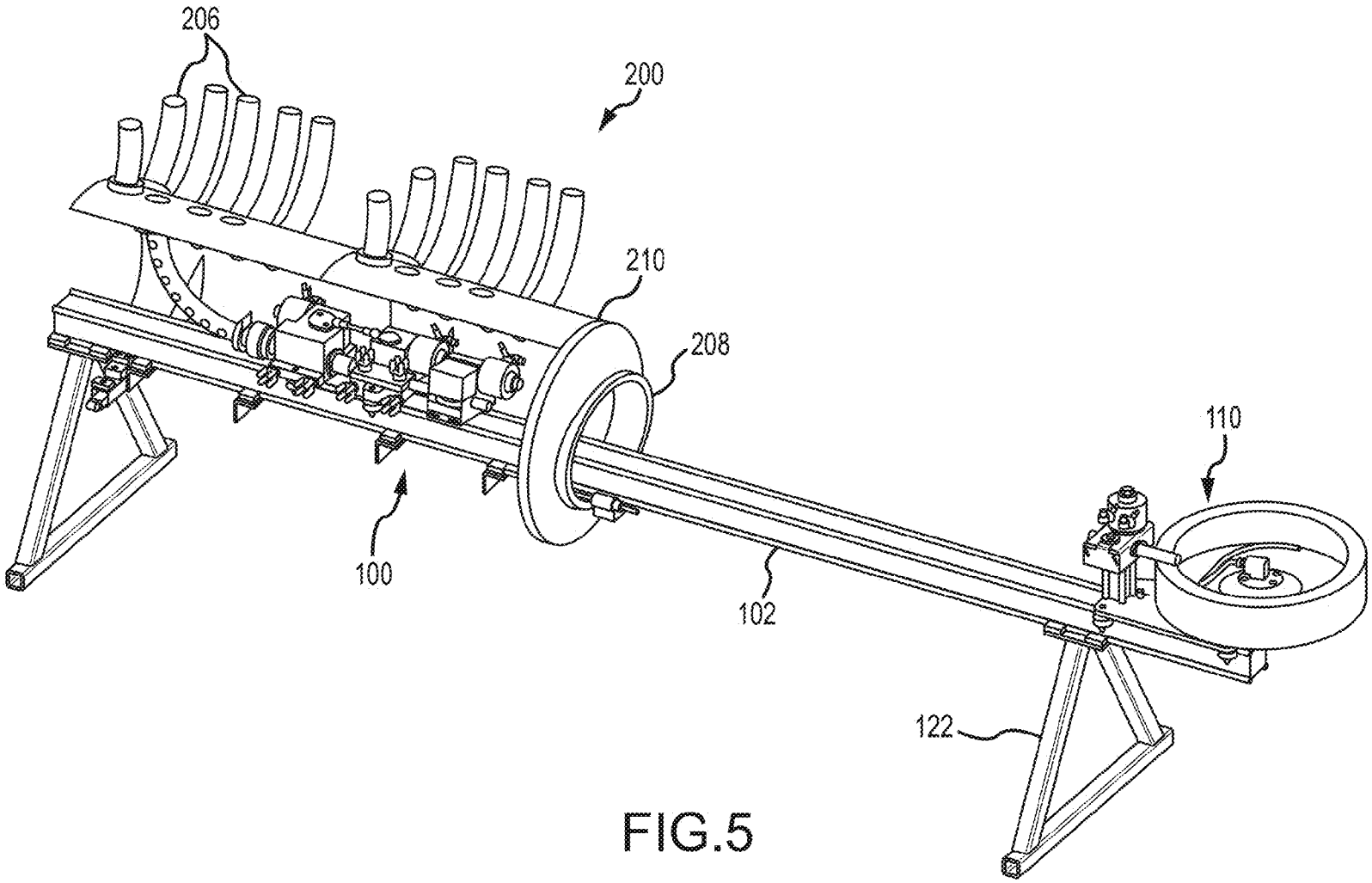
FIG. 5 is a view of the apparatus shown in FIG. 4 with the drive apparatus driven into position in registry with a tube within the water box of the package boiler mock-up.

The apparatus 100 is designed to fit within the manway 208 of a water box 210 as is shown by the mock-up of a water box 210 in FIGS. 4 and 5. The rail 102 is inserted into the water box 210 and a distal end of the rail 102 is fastened or supported by an adjustable strut 118 within the water box 210. The proximal end of the rail 102 is supported by the bottom edge of the manway 208. In the mock-up shown in FIGS. 4 and 5, the proximal end of the rail 102 is also supported by an optional bracket 122. Such a bracket 122 is merely for display purposes and may not be used or present adjacent an actual boiler water box.

Once the rail 102 is inserted into the water box 210, the rail 102 is adjusted so as to be exactly parallel to the longitudinal axis of the water box 210 and offset sufficiently such that a helix clad hose carried within the apparatus 100 mounted on the rail 102 will be coaxial with the axis of the water box 210. Clamp 120 fixes the rail 102 in position. FIG. 4 shows the apparatus 100 mounted adjacent to the water box 210. As is shown, the take-up module 110 is rollably mounted near the proximal end portion of the rail 102. The location of the take-up module 110 is adjustable along the rail 102 to avoid obstructions near the boiler 200 and to facilitate connection of a high pressure feeder hose to the helix clad hose 130 that is stored within the take-up module 110. A pin 153 in the base plate 152 of the take-up module 110 engages the slotted rail 102 to prevent movement of the take-up module 110 during apparatus operation. This take-up module 110 simply stores the helix clad hose coiled in a drum 124 for use. An air motor drive 126 mounted adjacent the drum 124 pushes the hose into the drum 124. This motor drive 126 preferably free-wheels to permit the hose coiled in the drum 124 to be withdrawn by the hose drive module 108, described in more detail below. The take-up module motor drive 126 contains the same drive sprockets and gears as the hose drive module 108, but has no worm gear reduction as is present in the hose drive module 108 as explained in further detail below.

Figure 3:
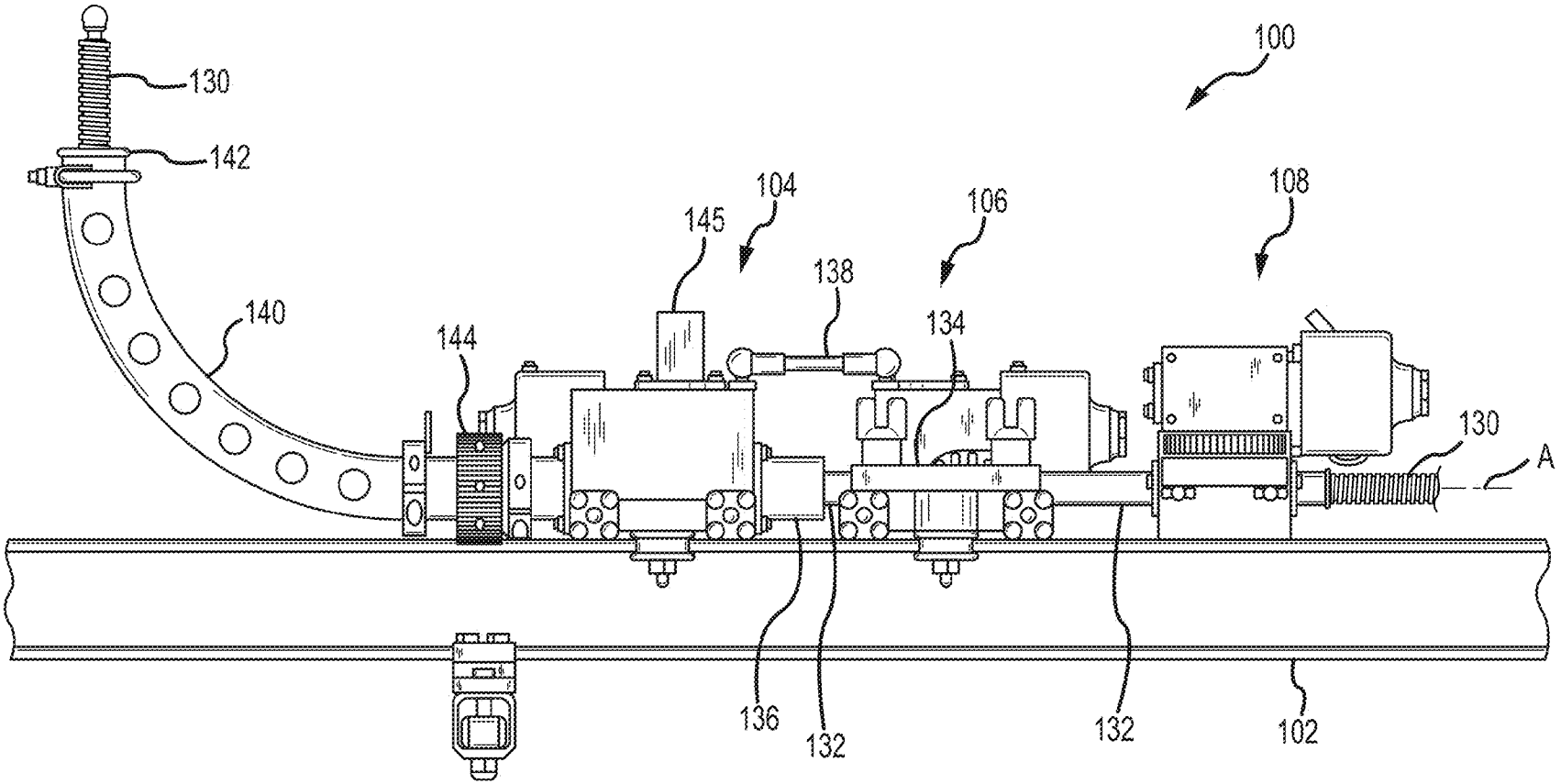
FIG. 3 is a side view of the flexible lance drive apparatus shown in FIG. 1.

Turning now to the enlarged side view of the apparatus 100 shown in FIG. 3, each of the modules 104, 106 and 108 are physically connected in tandem together and modules 104 and 106 are rollably mounted to the rail 102. The tractor module 106 operates to drive the apparatus 100 forward and back along the rail 102. The hose drive module 108 operates to drive the coil clad hose 130 through a conduit such as tube 132 that is clamped to the tractor module 106 and which fastens the hose drive module 108 to the tractor module 106. This tube 132 passes through a clamp 134 and extends into a rotatable sleeve 136 carried by the rotator module 104. The rotator module 104 is fastened in turn to the tractor module 106 via a link rod 138. The rotator module 104 rotates the sleeve 136 which in turn rotates an arcuate right angle guide tube 140 about the axis A of the apparatus 100 which is aligned coaxially with the axis of the water box 202, 204 or 210 into which the apparatus 100 is installed.

A composite mock-up of a water box 210 of a boiler 200 is shown in FIGS. 4 and 5. In order for the apparatus 100 to fit within the water box 202, 204 or 210, the arcuate right angle guide tube 140 must be partially released from the sleeve 136 in the rotator module 104, and permitted to rotate downward in the view shown in FIG. 3 so that the distal end 142 of the guide tube 140 can be lowered to pass through the manway opening 208 when driven by the tractor module 106 along the rail 102.

The release of the guide tube 140 is accomplished by loosening a knurled sleeve nut 144 that fastens the proximal end of the elbow guide tube 140 to the rotatable sleeve 136. Once the distal end 142 of the guide tube 140 is through the opening of the manway 208 by translation of the apparatus 100 along the guide rail 102, the knurled sleeve nut 144 is retightened to realign the proximal end of the guide tube 140 with the rotatable sleeve 136. When this action is completed the apparatus 100 may be driven via tractor module 106 to any desired position within the water box 210.

Each of the tubes 206 penetrating the water box 210 does so at precise positions with respect to the manway 208 and each other penetration. Therefore, when the apparatus 100 is first positioned within the water box 210 and the guide tube 140 retightened to the rotatable sleeve 136, a selected first one of the tubes 206 may be precisely located with respect to the distal end of the guide tube 140. That precise angle and longitudinal rail position is noted. The distal end of the guide tube 140 preferably is spaced from the actual tube penetration by about an inch. A flare fitting 146 may be installed on the distal end 142 of the guide tube 140 to adjust this spacing.

A view similar to that of FIG. 4 is shown in FIG. 5 in which the apparatus 100 is fully inserted within the water box 210. Each of the water box penetrations can be precisely located thereafter from the water box assembly drawings by knowing the precise location of a first one of the penetrations so that the apparatus 100 may be remotely positioned by an operator so as to be in registry with each water box penetration or opening in sequence. The operator can then operate the hose drive module 108 to extend a high pressure nozzle attached to the helix clad hose 130 into the tube 206 to be cleaned.

An optional remotely operated camera/light module 145, shown in FIG. 3, may be mounted to the top of the rotator module 104. This camera module 145 faces the end 142 of the guide tube 140 and captures images of the end 142 and the region within the water box 210 adjacent the end 142. The camera/light module 145 is preferably provided with a ring of LED lights around the camera lens to provide sufficient light within the waterbox 210 to illuminate the inner surface of the water box with its tube penetrations. The images from the camera are conveyed to a remote air motor operator's location (not shown) for display in a conventional manner to assist the operator in positioning the guide tube 140 end 142 in registry with the water box penetration of a desired heat exchanger tube 206.

Figure 6:
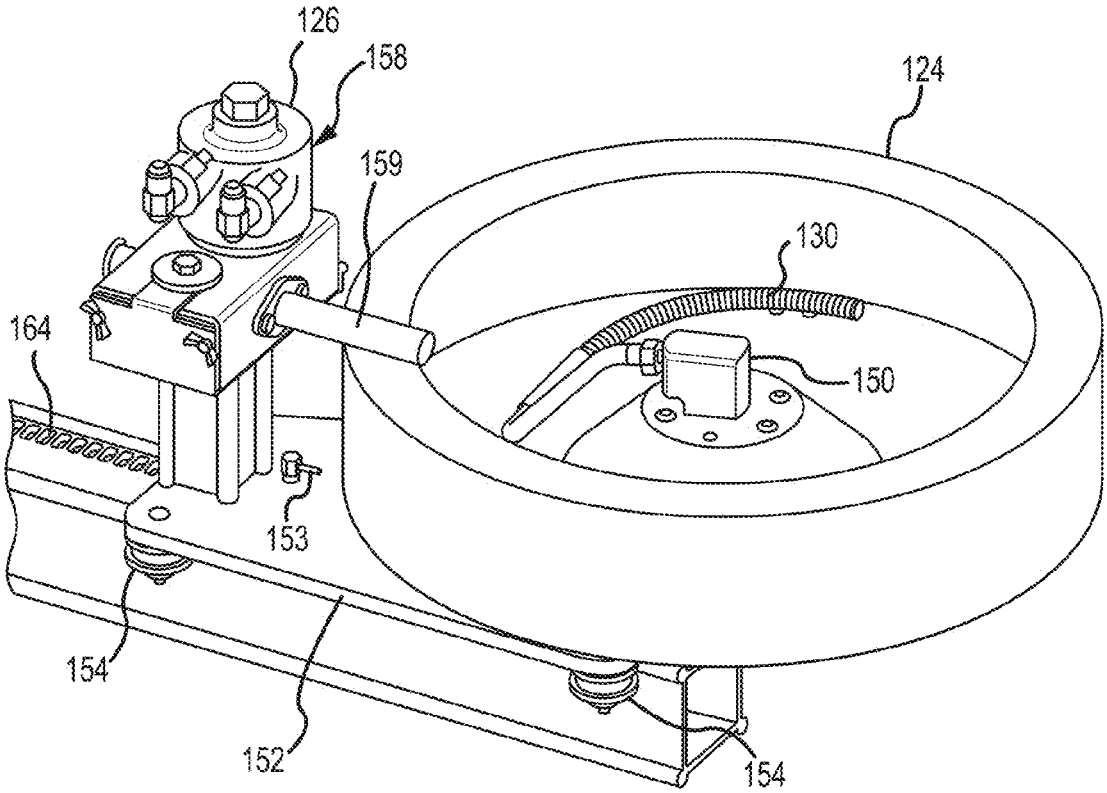
FIG. 6 is an enlarged separate perspective view of the take-up drum module of the apparatus shown in FIG. 1.

A separate perspective view of the take-up module 110 is shown in FIG. 6. This take-up module 110 includes a hollow drum reel 124 which is free to rotate about a swivel hose connection 150 to which one end of the helix clad hose 130 is connected. The swivel hose connection leads to a high pressure water source (not shown). The drum reel 124 is rotatably mounted on a plate 152 that is rollably mounted via rollers 154 to the ribs 156 of the rail 102 (see FIG. 7). A retractable pin 153 engaging ladder notches 164 in the rail 102 permits the take-up module 110 of the apparatus 100 to be fixed at any position along the rail 102. Also mounted to the plate 152 is a guide assembly 158 and an air motor hose drive 126 that drives retraction of the hose 130 into the drum 124 and permits freewheel movement of the hose 130 out of the drum 124.

Figure 11:
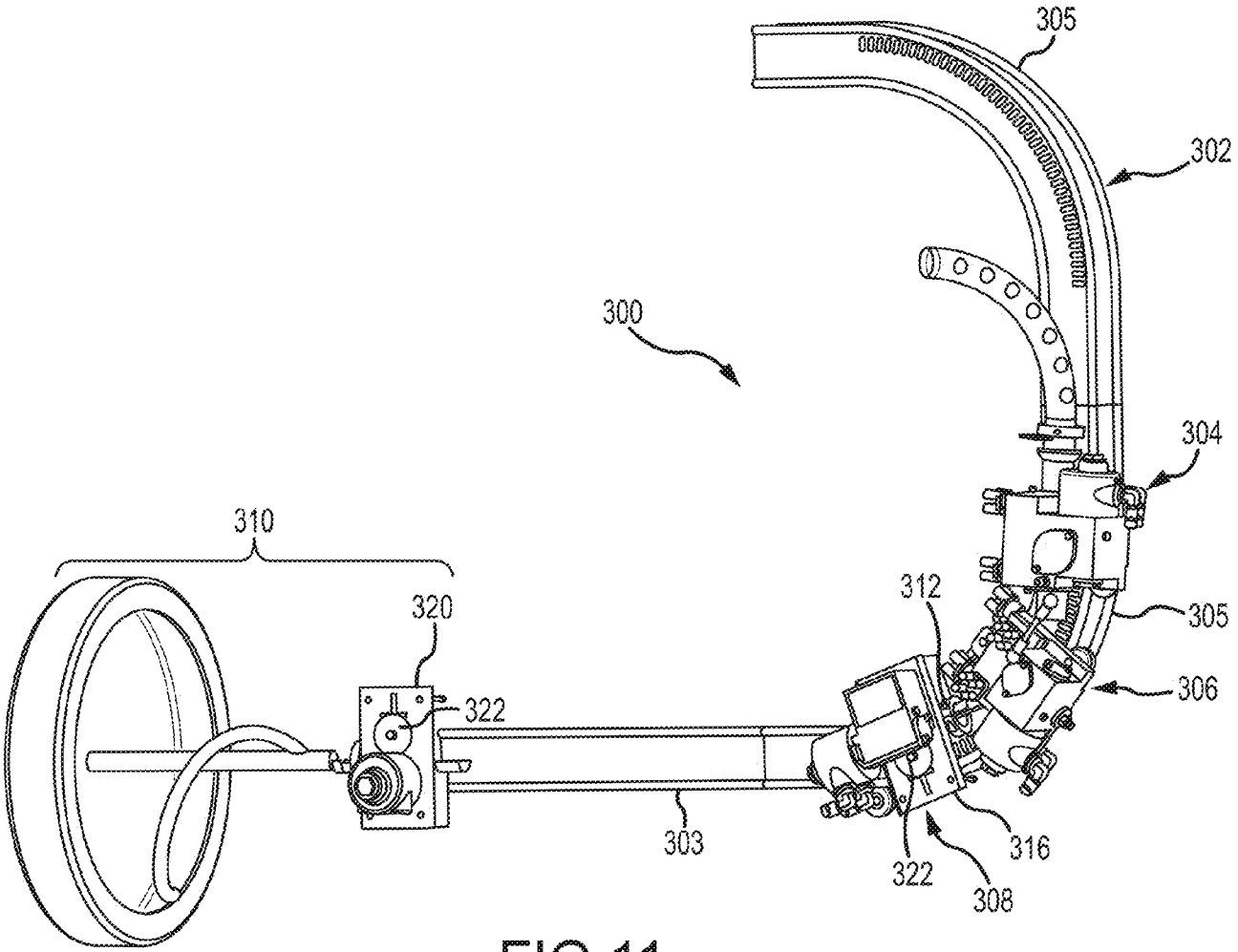
FIG. 11 is a perspective upper view of an alternative apparatus in accordance with the present disclosure.
Figure 12:
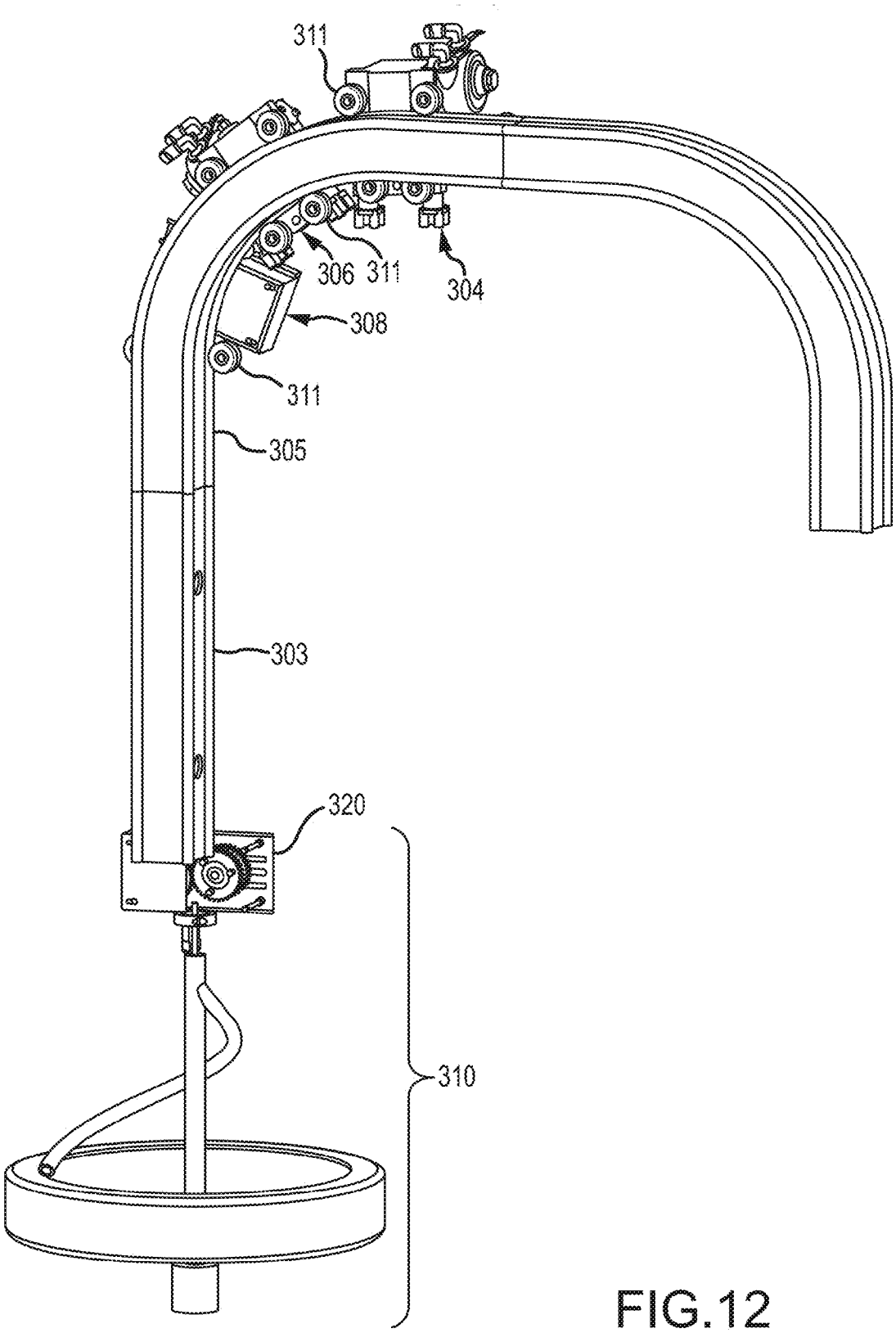
FIG. 12 is a perspective underside view of the alternative apparatus shown in FIG. 11.
Figure 13:
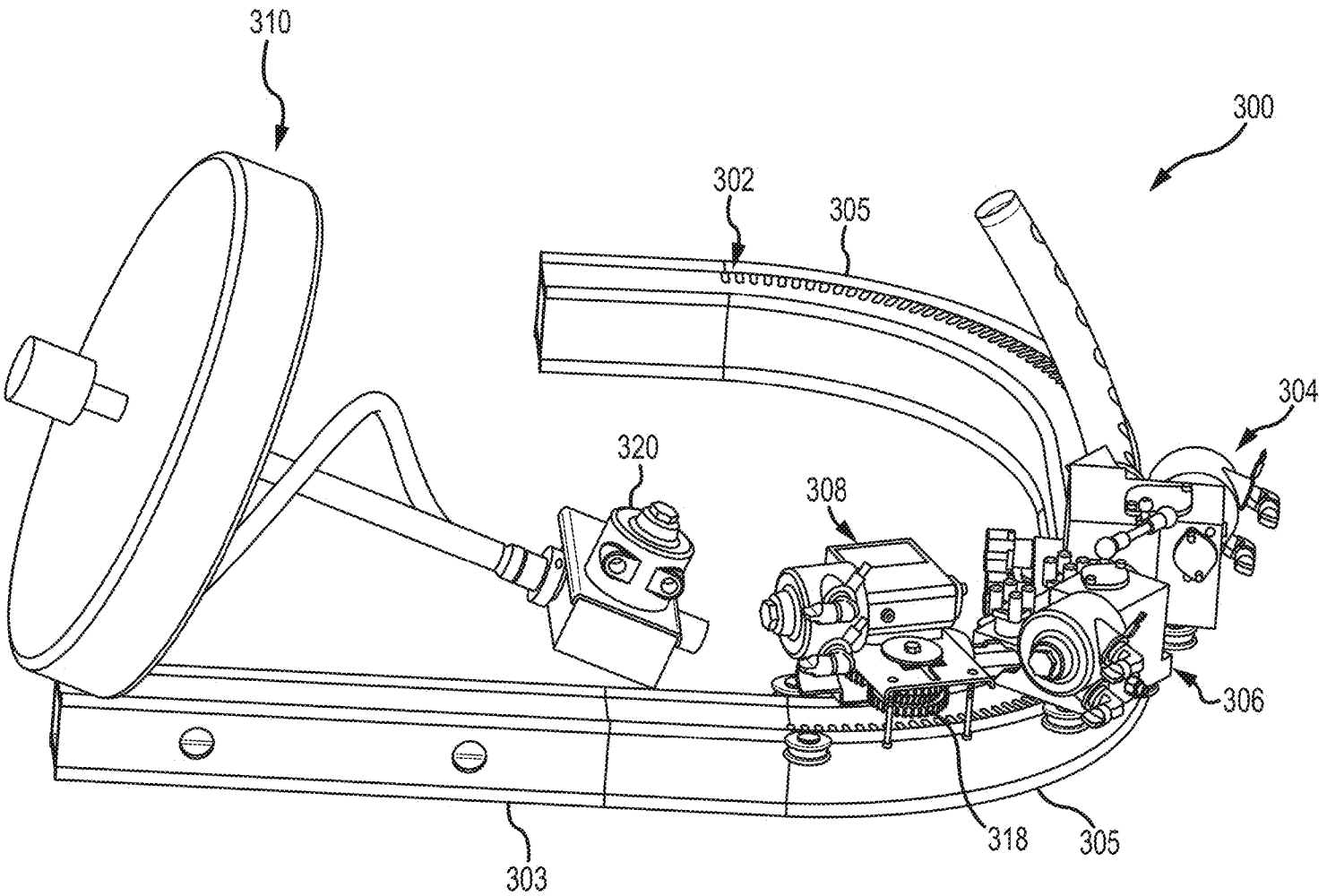
FIG. 13 is a perspective view of an alternative arrangement of a hose rotator drum module in the apparatus shown in FIG. 11.

The rail 102 preferably has a square cross section, with axially extending ribs 156 at each corner, and the rail 102 may be provided in straight or curved segments joined together in any combination, such as is shown in FIGS. 11-13. The top wall 162 of the rail 102 has spaced ladder notches or openings 164. A spur drive gear 168 (See FIG. 9) in the tractor drive module 106 engages these ladder notches 164 to move the apparatus 100 along the rail 102 between the positions shown in FIGS. 4 and 5.

Referring now to FIG. 9, the tractor drive module 106 includes an air motor 170 that fits within a drive housing 172 and drives a worm gear set assembly 174 that drives the spur gear 168 that engages the ladder notches 164 in the top wall 162 of the rail 102. A conical clutch adjustably engaged by Bellville washers allows the spur gear 168 to slip without damage if the drive module 106 encounters an obstruction. The housing 172 is fastened to the ribs 156 of the rail 102 by three rollers 154. A hose guide tube clamp assembly 176 is bolted to the housing 172. This clamp assembly 176 clamps to the hose guide tube 132 which is in turn fastened to the hose drive module 108.

The hose drive module 108 is shown in an exploded assembly view in FIG. 8. The module 108 includes an air motor 190 fastened to a split box housing 191. The air motor 190 drives an input worm and worm gear assembly 192 coupled to a drive axle 194. Drive axle 194 drives a drive sprocket 196 sandwiched between two guide gears 198. A set of an idler drive sprocket 197 sandwiched between two idler guide gears 199 are spaced above the drive sprocket 196 that mesh with the guide gears 198. The helix clad hose 130 is guided by the meshed sets of guide gears 198 and 199 and propelled between the drive sprockets 196 and 197 through the guide tube 132. The hose drive module 108 is not fastened to the rail 102. It is fastened to the tractor module 106 via the guide tube 132.

The rotator module 104 is shown in an exploded perspective view in FIG. 10. The rotator module 104 has a driven rotatable sleeve tube 136 that is bearing supported in housing 220. Housing 220 is in turn rollably mounted onto the ribs 156 of the rail 102 via three rollers 154 engaging the ribs 156, two on one side of the rail 102 and the third on the opposite side of the rail 102. The module 104 includes an air motor 222 which drives a worm gear assembly 224 which in turn rotates the sleeve tube 136 about an axis parallel to the rail 102. This rotation permits the guide tube 140 to rotate about an arc of about 180° above the rail 102 to place the end 142 in registry with one of the tubes such as tube 206 to be cleaned.

Many changes may be made to the apparatus, which will become apparent to a reader of this disclosure. For example, the rail 102 and its longitudinal axis may be curved, rather than straight, as shown in FIGS. 11-13, and its use and size may vary depending on the precise configuration of the object to be cleaned. Tube penetration arrays of other geometries, e.g. arrays not radially deployed in water boxes, for example, are also envisioned as within the scope of use of the positioning apparatus of the present disclosure. The precise arrangement of the rotator elbow guide 140 and rotator module 104 may be other than a right angle elbow guide 140 as shown. Furthermore, translation of external surface cleaning tools, is also potentially a use for this positioning apparatus 100 on a straight, or curved, rail 102. Each of the three wheeled modules 104, 106 and 110 may be carried on a custom rail 102 configured precisely for the task at hand. Because each of the modules 104 and 106 are carried on three rollers 154, various configurations of rail curvatures may be accommodated.

The apparatus 100 may be inverted with the modules 104, 106 and 108 riding beneath the guide rail 102. This inverted configuration is appropriate if the apparatus 100 or 200 is being inserted within a water box 202 shown in FIG. 2 so that the module 104 can direct the curved guide tube 140 downward at the appropriate angle for insertion into one of the tubes 206. Each of the coupling guides or sleeves 132, 136, 324 and 328 may be constructed in separable halves, i.e. split axially in order to accommodate changes required for different hose sizes without full disassembly of the modules 104, 106, 108 or the drive 126 of the module 110.

Figure 14:
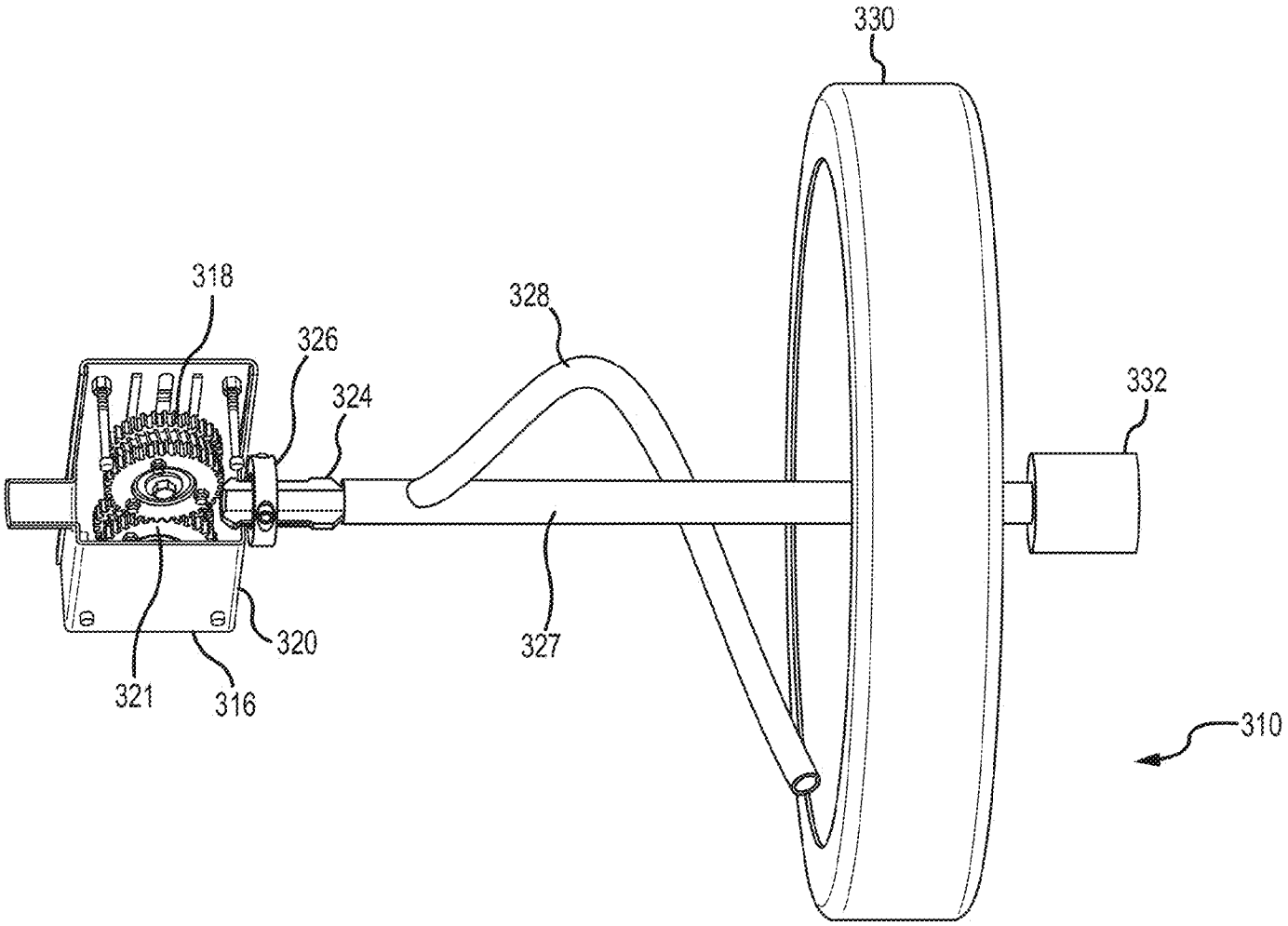
FIG. 14 separate perspective view of a hose rotator drum module in accordance with the present disclosure shown in FIGS. 11-13.

Another embodiment of an apparatus 300 in accordance with the present disclosure is shown in FIGS. 11 through 13. FIG. 12 is a perspective underside view of the alternative apparatus 300 shown in FIG. 11. FIG. 13 is a perspective view of an alternative arrangement of a hose rotator drum module 310 in the apparatus 300 shown in FIG. 11. FIG. 14 is a separate perspective view of a hose rotator drum module 310 in accordance with the present disclosure shown in FIGS. 11-13.

Apparatus 300 includes a guide tube rotator module 304 and a tractor module 306 mounted on a guide rail 302 similar to that shown in FIGS. 1-9 and described above. This guide rail 302 is constructed of a series of straight, and/or curved, rail segments 303, 305 connected in series. The curved rail segments 305 are preferably arcuate and may have a track bend radius as short as on the order of 15 inches at the track centerline. For tighter radii, a different number of and/or spacing of the rollers 311 may be needed on the modules 304 and 306 than as shown in FIG. 12. For a longer radius, the three rollers 311 are sufficient. Any number and arrangement of segments 303 and 305 may be used as might be needed in a particular application, in order to work around obstacles or enter confined work spaces. A helix hose drive module 308 may optionally be attached to the tractor module 306 via a swivel or pivot joint tube 312. Furthermore, the elbow/curved tube rotator module 304 may differ from that shown in FIGS. 11-13, as this configuration is merely exemplary.

This helix hose drive module 308 preferably has a split box housing 316 wherein the follower gear sprocket stack 318 may be slidably separated from the driven gear sprocket stack 321 to accommodate entry and exit of helix clad hoses 130 of different outer diameters. See FIG. 16 for an enlarged partial sectional view of a split box housing 316. In such a configuration the follower gear sprocket assembly axle bolt 322 is slidably mounted in a slot in the split box housing 316. In order to change hose sizes, the axle bolt 322 is loosened, the follower gear sprocket assembly 318 is slid outward so as to open the housing 316 to receive the new diameter hose. The follower gear sprocket stack assembly 318 is then moved back into position to engage the helix clad hose 130, and the axle bolt 322 retightened. These hose drive modules 108, 208, and 308 each includes a 10:1 up to 40:1 worm gear reducer 192, (shown in FIG. 8) to provide needed torque and thrust on the helix drive hose 130 to set the cleaning rate for the tool assembly.

An underside view of the apparatus 300 is shown in FIG. 12 to clearly show the roller 311 arrangements on the modules 304, 306 and 308 engaging the curved and straight portions of the rail 302.

A hose rotator supply drum module 310 is preferably fastened to a straight rear end segment 303 of the guide rail 302 as is shown in FIGS. 11 and 12. Optionally this drum module 310 may be mounted on a platform rollably fastened to the rail 302 such that the drum rotates above the rail 302 as is illustrated in FIG. 13. In either case, the hose drum module 310 preferably includes a split box reversible take-up drive 320 for extending and retracting the helical clad hose 130. This split box take-up drive 320 is similar to that in module 308 except that drive 320 includes no gear reduction between the air motor 190 and driven sprocket stack 321. This lowers the torque that can be applied by the air motor 190 in the take-up drive 320. The drive 320 is designed to hold a constant tension in the hose 130 proportional to the air pressure applied. This motor 190 in the drive 320 can be back-driven by pulling on the hose 130. In general, drive 320 is designed simply to maintain some tension on the hose 130 as it is played out to the tractor module 306 and optionally through the hose drive module 308, and collect hose 130 into the drum 330 during retraction.

Figure 15:
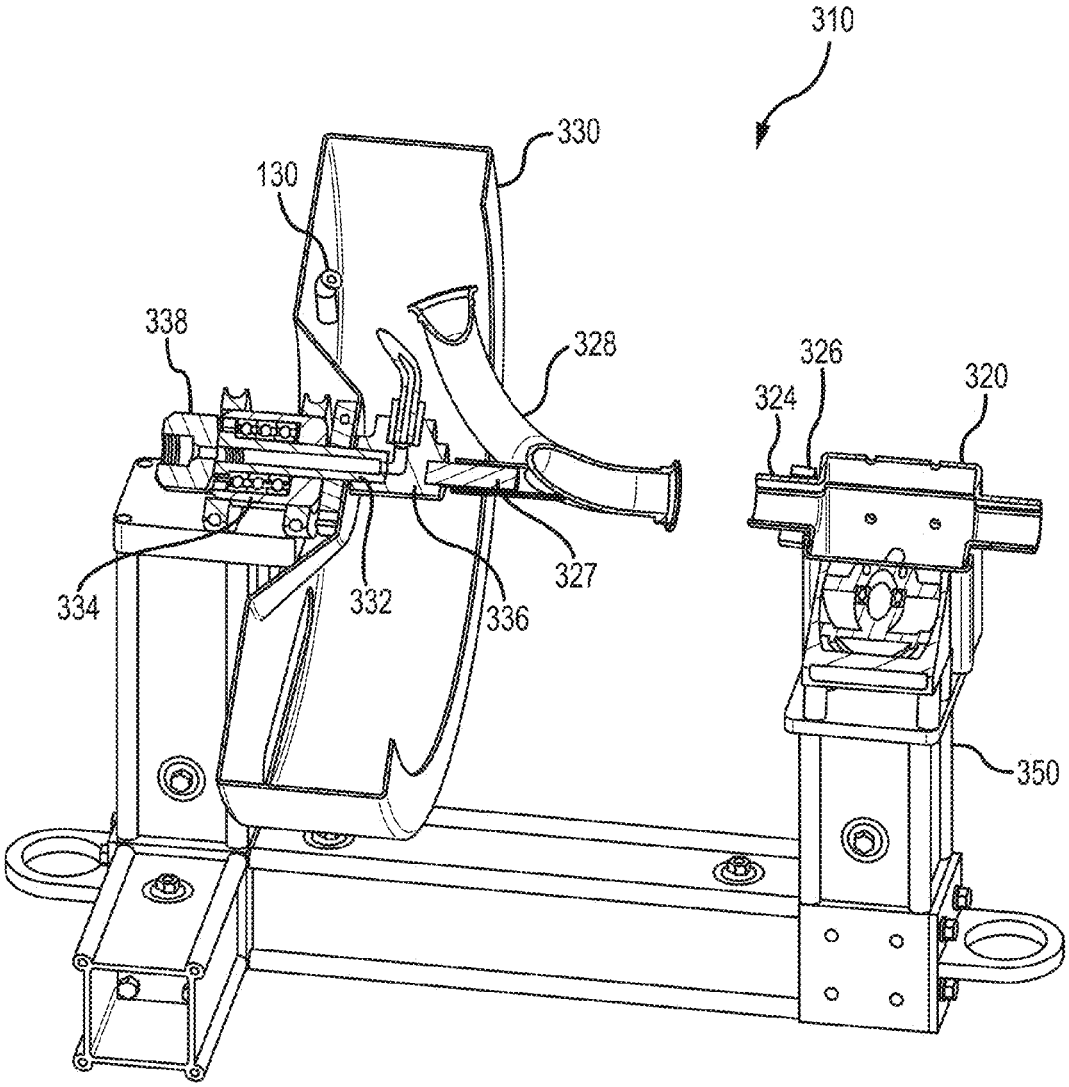
FIG. 15 is a separate perspective view of a hose rotator drum module shown in FIG. 14 mounted on a stationary frame, with portions broken away to show internal structure.

A separate enlarged perspective view of one embodiment of a hose rotator supply drum module 310 is shown in FIG. 14. A more detailed view of an exemplary hose rotator supply drum module 310 is shown in FIG. 15 mounted on a floor support 350. The split box housing hose drive motor 320 carries a split bushing 324 and a collar 326 which holds the bushing halves together. Abutting the split bushing 324 is a straight structural shaft 327 that diverts to a spiral helical tube 328 at its distal end adjacent the split bushing 324. This spiral helical tube 328 directs hose 130, shown in FIG. 15, into and out of the inner cavity of the drum 330. The proximal end of the shaft 327 is fastened to a swivel shaft 332 which conducts fluid into the drum 330 via an elbow 336. The swivel shaft 332 is supported for rotation at its proximal end by bearing 334 which is mounted on the stationary support 350. The drum 330 is free to rotate about the structural shaft 327, which can be gapped from bushing 324 or rotatably connected to the bushing 324. In addition, the structural shaft 327 is bearing mounted so as to be free to rotate about its central axis between the bushing 324 and the bearing 334 on the swivel shaft 332. This swivel shaft 332 abuts a stationary inlet nut 338 to which a high pressure feed hose, not shown, is connected in order to supply high pressure fluid to the hose 130. In some configurations, part or all of the frame 350 may be eliminated if the connection between structural shaft 327 and the bushing 324 is used to fully support the drum 330 and inlet nut 338.

Optionally a rotary drum drive motor (not shown) for rotating the hose take-up drum 330 may be provided, which would be connected to the rotary drum 330 via, for example, a drive belt and motor. If the rotary drum 330 is so driven, it would rotate the hose 130 so that a nozzle connected to the distal end of the hose 130 would also rotate in order to navigate through short radius bends in a piping system into which the flexible lance hose 130 is inserted.

The apparatus 300 may be alternately be assembled and utilized upside down on a track 305 as opposed to the configuration shown with the modules 304, 306 and/or 308 mounted to the top of track 305, i.e. being upright as shown in FIGS. 1-15.

For certain applications, the helix drive module 308 may be unnecessary, relying only on the split box reversible drive motor 320 for forward and reverse extension of the hose 130. For other applications, the opposite may be true, i.e., split box reversible drive motor 320 may be dispensed with if the supply drum module 310 may be placed close to the helix drive module 308.

Figure 16:
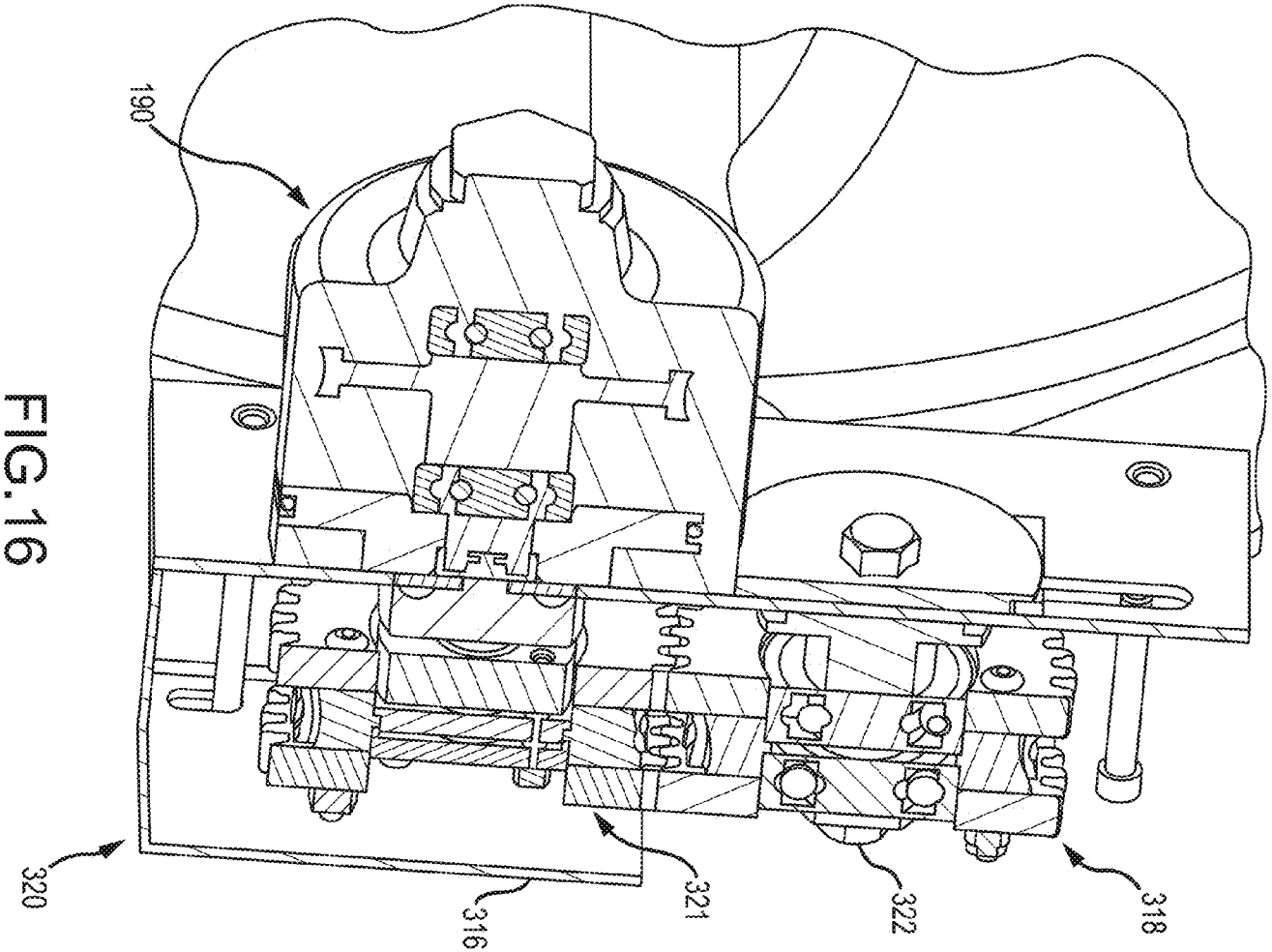
FIG. 16 is an enlarged partial sectional perspective view of a helical clad hose drive assembly used in the hose rotator drum module shown in FIG. 14 and also shown in FIG. 8.

A separate perspective close-up view of an exemplary split box helix clad hose take-up drive module 320 is shown in FIG. 16. The take-up drive 320 includes an air motor 190 fastened to a split box housing 316 (See FIG. 8) fastened to the support structure 350, or, in the embodiments shown in FIGS. 1-12, to the rail 102, 302. This drive 320 is the same as the hose drive module 108, 308 except that in module 108, 308, a gear reduction assembly is incorporated between the air motor 190 and the driven sprocket stack 340. This permits a much larger torque to be applied to the hose 130 in the drive module 108, 308.

Figure 17:
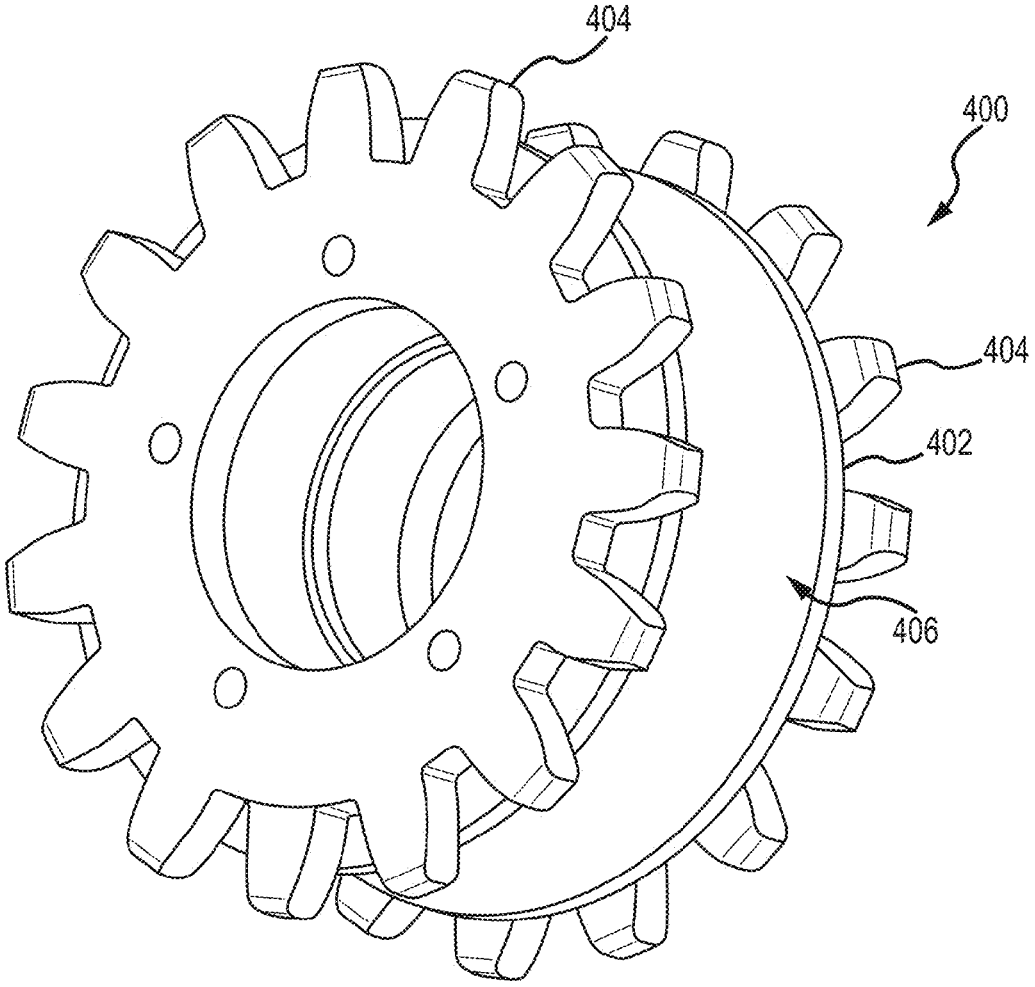
FIG. 17 is a perspective view of a bullgear and sprocket/roller assembly removed from the drive assembly shown in FIG. 16, configured for use in driving non-helix clad high pressure lance hose.

A separate view of a gear and sprocket subassembly 400 for use with a smooth flexible lance hose in either the drive module 108, 308 or the take-up module 110, 310 is shown in FIG. 17. This assembly 400 includes a urethane grooved roller 402 sandwiched between two spur bull gears 404. The sandwich of bull gears 404 and roller 402 are bolted together and mounted either on a driven shaft or on a parallel follower shaft. Two assemblies 400 are supported, for example, in the drive housing 320, as shown in FIG. 14, in opposition such that the bull gears 404 mesh, with the grooved rollers 402 capturing and confining the flexible lance hose (not shown in FIG. 14). The annular groove 406 formed in the roller 402 is selected to complement the particular hose diameter of the flexible lance being used. Currently it is envisioned that the roller 402 may have a 4 inch outer diameter with a central groove diameter ranging from 0.4 inch to 1.09 inch. The width of the roller 402 is identical to that of the helical clad hose drive roller 196, 197 shown in FIG. 8 and used in each of the embodiments described with reference to FIGS. 1-16 except that no sprocket teeth are needed since there is no helical wire wrapping around the hose.

Figure 18:
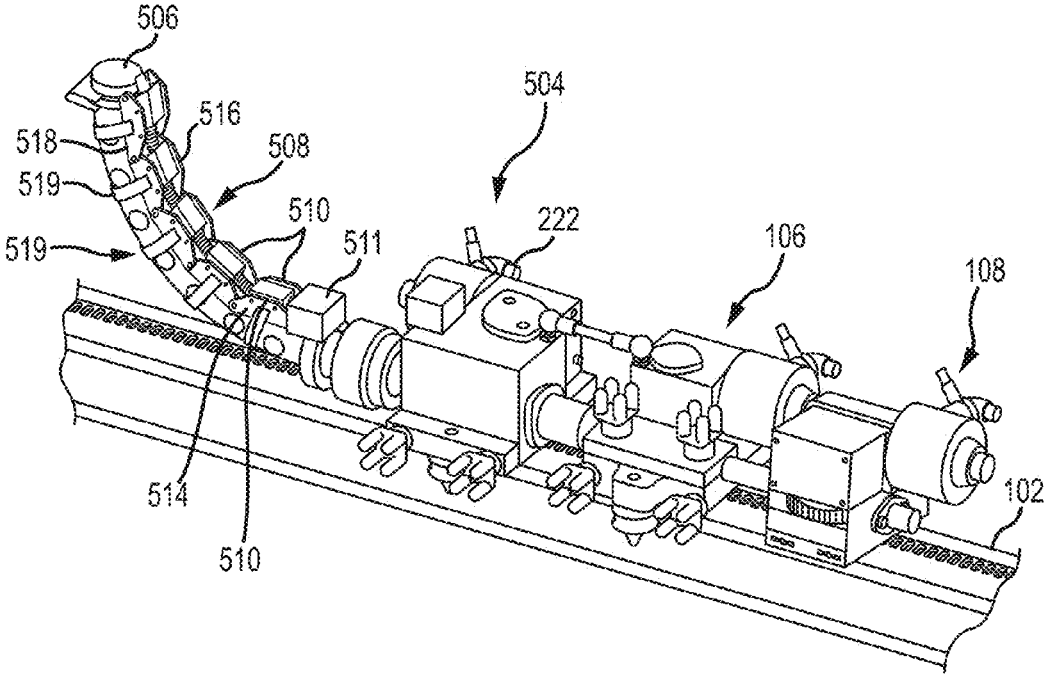
FIG. 18 is a partial perspective view of the apparatus shown in FIGS. 1-4 incorporating a remotely operated flexible guide tube drive mechanism attached to the rotator module.

An alternative embodiment 504 of the guide rotator module 104 is shown in FIG. 18. This rotator module 504 rolls on the rail 102 as above described with reference to FIGS. 1 through 16. The rotator module 504 replaces the angle guide tube 140 with a flexible tube 506, which may alternately be a bendable, articulated or corrugated metal tube structure, for very high temperature operations, or may be a plastic tube such as high density polyethylene for normal water temperature operations. The rotator module 504 includes a curl or bend adjustment assembly 508 fastened alongside the tube 506 that is connected to an air motor 511. This bend assembly 508 extends the guide tube 506 from a straight axial position along the rail 102 to a curled, preferably at least a 90° bend relative to the track or rail 102. The bend assembly 508 includes a plurality of link assemblies 510, preferably five or six, joined together in series via universal joint cross-members 529. This is done so that each pair of link assemblies causes an identical curl or bend to occur between each linked assembly 510.

Figure 19:
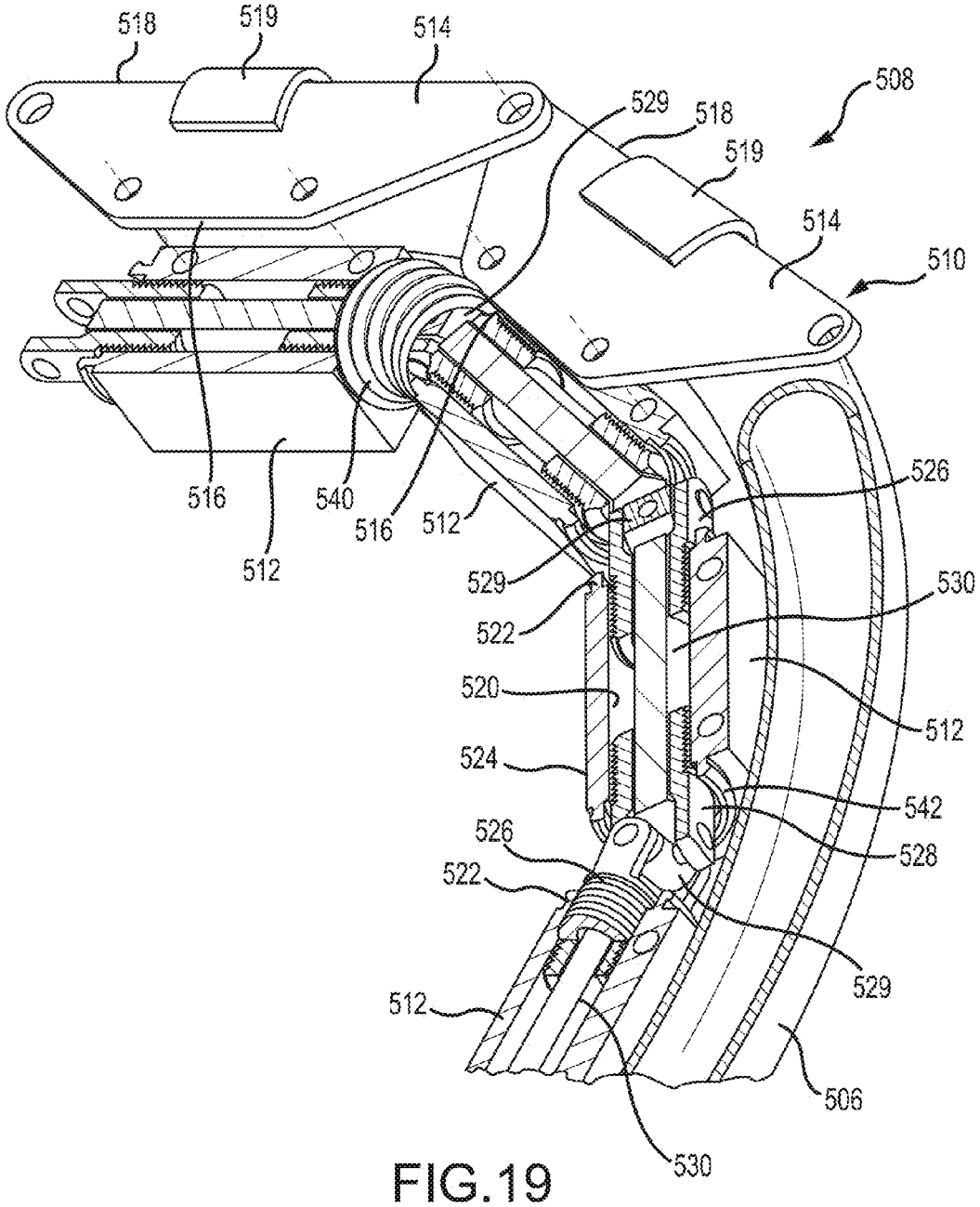
FIG. 19 is an enlarged partial sectional view of the flexible tube drive mechanism shown in FIG. 18.

An enlarged perspective view of several connected link assemblies 510 in the bend assembly 508 is shown in FIG. 19 with portions in section to illustrate the mechanical structure within each of the link assemblies 510. Each link assembly 510 includes a rectangular link block 512 fastened to two parallel trapezoidal side plates 514. The short side 516 of one side plate 514 is fastened to one side of the link block 512. The short side 516 of the other side plate 514 is fastened to a corresponding opposite side of the link block 512 so as to extend parallel to the first side plate 514. The long sides 518 of the side plates 514 are each fastened at their ends rotatably to adjacent side plates 514 of an adjacent link assembly 510.

Each link assembly rectangular block 512 has a central axial bore 520 therethrough. The block 512 is internally oppositely threaded at opposing ends of the central bore 520. As an example, shown in FIG. 18, the right end 522 of block 512 has internal right hand threads. The left end 524 of the block 512 has internal left hand threads.

Threaded into the right hand end 522 of rectangular link block 512 is right hand threaded universal joint fork 526. Threaded into the left hand end 524 of the rectangular link block 512 is a left hand threaded universal joint fork 528. Only one cross pin 529 joining adjacent universal joint forks 526 and 528 is shown in FIG. 18 simply for clarity. Each of the universal joint forks 526 and 528 has a central hexagonal bore slidably receiving a hexagonal shaft 530 therein. The hexagonal shaft 530 is free to rotate and slide back and forth within the central bore through the block 512, slide within and couple the forks 526 and 528 such that rotation of one fork 526 causes identical rotation of the other fork 528 within the block 512 via the hexagonal shaft 530. As viewed in FIG. 18, when one fork 526 is rotated clockwise, for example, the other fork 528 in the same block 512 must rotate clockwise. Because these forks and the block are oppositely threaded, when fork 526 is rotated clockwise it enters the block 512 and the same time, the fork 528 rotates clockwise, also entering the block 512 such that they are drawn closer together. Conversely, when rotated counter-clockwise, the two yokes 526 and 528 move axially farther apart.

When five or six of these link assemblies 510 are connected together in series by the universal joint crosses 529, rotation of one fork 526 in a clockwise direction causes every other fork, or yoke, in the connected string of assemblies 510 to rotate clockwise, thus drawing adjacent link assemblies 510 closer together. Because the long side 518 of each side plate is linked to an adjacent link assembly long side 518, rotation of the universal joint forks 526 and 528 causes the upper short sides 516 of each adjacent assembly 510 to be drawn together or spread apart while the connection between the long sides 518 remain fixed. This causes the entire train of link assemblies 510 to incrementally form a curl or curve when the forks 526 and 528 are rotated in one direction and straighten when the forks are rotated in an opposite direction.

The guide tube 506 is preferably held between the long edges of the side plates 514 beneath the blocks 512 via straps 519. Rotation of the universal joint forks 526 and 528 in one direction causes the series connected links 510 to curl or form a curve. Rotation in the opposite direction cause the series connected links 510 to straighten.

A rubber accordion sleeve boot 540 is installed between each adjacent assembly 510. The rubber boot 540 may be an accordion type sleeve made of silicon rubber or other flexible polymer with a bead around each end of the sleeve. Each end of the blocks 512 has a complementary annular groove 542 therearound that receives the bead so that the sleeve boot 540 completely encloses and hermetically seals the joint between each of the assemblies 510. Not only do the boots 540 prevent moisture entry during operation of the module but they also retain lubricants within the assembly 508.

An air drive motor 511 for adjustably curling the guide tube 506 up or away from the axis A of the guide rail 102. This motor 511 is preferably mounted to the assembly 504 adjacent the rotator motor 222 for rotating the guide tube assembly 506 about the axis A of the rail 102. For example, if each pair of link assemblies 510 can move through an angle of about 30°, a series linkage of seven link assemblies 510 (six universal hinge links) would be just needed to direct the distal end of the guide tube 508 from straight to back on itself, i.e. through a right angle to a maximum of 180° bend with respect to the axis of the rail 102.

Figure 20:
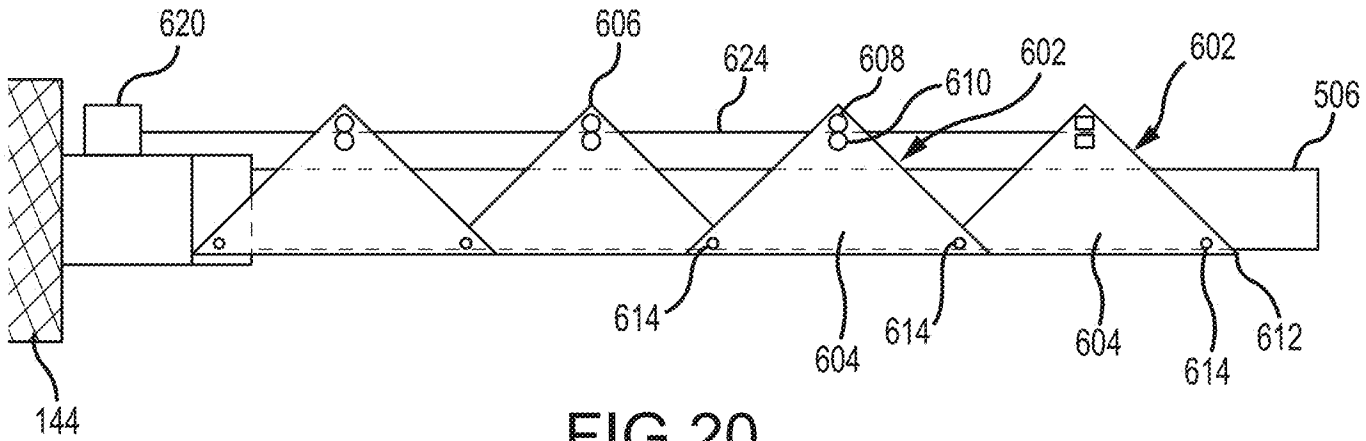
FIG. 20 is schematic side elevational view of an alternative flexible guide tube drive mechanism.
Figure 21:
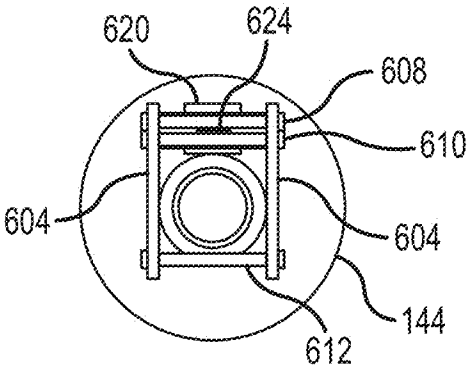
FIG. 21 is a distal end view of the alternative guide tube drive mechanism shown in FIG. 20.

Another structure 600 for providing a controlled bend or curl of the guide tube 506 is shown in FIGS. 20 and 21. In this alternative embodiment, each link assembly 602 includes a pair of spaced parallel triangular side plates 604 utilized instead of trapezoidal side plates. The apex 606 of each triangular side plate 604 is parallel to and spaced from an opposite side plate apex 606 by a pair of vertically spaced roll pins 608 and 610. The bottom corners 612 of each of the side plates 604 are spaced apart by axle pins 614. At least one of the axle pins 614 also joins each assembly 602 to an adjacent link assembly 602. The guide tube 506 is carried between the bottom axle pins 614 and the lower roll pins 610 across the apex 606 of the triangular side plates 604. A drive motor 620 is fastened to the rotator housing 622. A retractable flexible tape 624 extends from the drive motor 620 through each pair of roll pins 608, 610 and its distal end 626 is fastened between the last pair of roll pins 608, 610. This retractable tape may include perforations (not shown) that engage a drive sprocket in the drive motor 620 contained in the drive housing 622 such that when the tape 624 is retracted it rolls up into the drive housing 622 as the distal end of the guide tube 506 curls up and away from the track 102. When the tape is extended by the drive motor 620, the distal end of the tape pushes against the last linkage such that it causes the distal end of the guide tube 506 to straighten and align parallel to the guide rail 102 as is shown in FIG. 20. When the drive motor is reversed, the tape retracts, pulling the distal end of the tape, which in turn causes the distance between each of the apexes to contract, causing the guide tube 506 to curl or bend upward as viewed in FIG. 18.

Many changes may be made to the apparatus described above, which will become apparent to a reader of this disclosure. Various combinations of modules 104, 106, 108, 110 and/or 304, 306, 308 and 310 may be separately utilized or linked together, in various combinations, depending on a specific target object to be cleaned. The embodiments described above are merely exemplary. Tube penetration arrays of other geometries, e.g. arrays not radially deployed in water boxes, for example, are also envisioned as target objectives to be cleaned within the scope of use of the positioning apparatus of the present disclosure.

For example, the hose rotator supply drum module 310 shown in FIGS. 14 and 15 coupled to a split box housing hose drive motor 320 may be utilized to facilitate driving a flexible lance hose as it negotiates through a series of 90° bends in a piping system being cleaned. In such an application the flexible lance hose may be a conventional smooth walled high pressure hose, or it may be a helix clad hose 130. In the former case, the drive motor 320 would utilize a gear and sprocket subassembly 400 as shown and described above with reference to FIG. 17. In such an application, the module 310 may be mounted on a rail 102, 302 as per FIGS. 11-14 or may be a standalone setup such as is shown in FIG. 15. Therefore all such changes, alternatives and equivalents in accordance with the features and benefits described herein, are within the scope of the present disclosure. Such changes and alternatives may be introduced without departing from the spirit and broad scope of this disclosure as shown herein and defined by the claims below and their equivalents.

What is claimed is:

1. A flexible high pressure fluid cleaning lance positioning and drive apparatus comprising:

a guide rail having a portion adapted to be inserted into a heat exchanger water box and having a longitudinal axis;

a hose guide conduit mounted parallel to the guide rail via a tractor drive module mounted on the guide rail for movement of the hose guide conduit and tractor drive module along the guide rail into and out of the water box;

a high pressure fluid hose drive module connected via the hose guide conduit to the tractor drive module on the guide rail operable to propel a flexible high pressure fluid lance hose through the hose guide conduit along an axis parallel to the guide rail longitudinal axis; and an angle guide rotator module mounted on the guide rail receiving one end of the hose guide conduit and connected to the tractor drive module separately from the hose guide conduit operable to guide the flexible high pressure fluid lance hose into and through one end of an arcuate right angle guide tube and adjustably positioning an opposite end of the arcuate right angle guide tube in registry with a tubular object accessible from the water box to be cleaned and guiding the flexible high pressure fluid lance hose through the arcuate right angle guide tube into the tubular object to be cleaned.

2. The apparatus according to claim 1 wherein the tractor drive module is connected to the hose drive module by the hose guide conduit for carrying the high pressure fluid lance hose.

3. The apparatus according to claim 1 further comprising a hose take-up drum module proximate the guide rail and spaced from the hose drive module operable to collect and dispense the flexible high pressure fluid lance hose from and to the hose drive module.

4. The apparatus according to claim 2 wherein the flexible high pressure fluid lance hose is a helix coil clad hose.

5. The apparatus according to claim 1 wherein the rotator module includes a rotatable sleeve aligned with the conduit from the hose drive module and removably connected to one end of the arcuate right angle guide tube and a drive motor connected to the rotatable sleeve for rotating the connected arcuate right angle guide tube about an axis through the rotatable sleeve.

6. The apparatus according to claim 1 wherein the tractor drive module is rollably supported on the guide rail.

7. The apparatus according to claim 6 wherein the rotator module is rollably supported on the guide rail.

8. The apparatus according to claim 1 wherein each of the rotator and tractor drive modules are rollably supported on the guide rail by two rollers riding on one rib of the guide rail and one roller riding on a parallel rib of the guide rail.

9. The apparatus according to claim 1 wherein the rotator module rotates a tubular sleeve receiving therein the hose guide conduit fastened to both the tractor drive module and the hose drive module.

10. The apparatus according to claim 9 wherein the rotator module is connected to the tractor drive module by an elongated link separate from the tubular sleeve.

11. A flexible high pressure fluid cleaning lance positioning and drive apparatus comprising:

an elongated guide rail having a longitudinal axis, a portion adapted to be inserted into a heat exchanger water box and a top wall defined by two parallel ribs extending parallel to the longitudinal axis of the guide rail;

a tractor drive module mounted on the ribs of the guide rail;

a high pressure fluid hose drive module on the guide rail operable to propel a flexible high pressure fluid lance hose along an axis parallel to the guide rail longitudinal axis;

a high pressure fluid hose guide conduit clamped to each of the tractor drive module and high pressure fluid hose drive module and aligned parallel to the guide rail longitudinal axis; and an angle guide rotator module mounted on the ribs of the guide rail and connected to the tractor drive module, via a separate link, for rotatably positioning an arcuate right angle guide tube in registry with a tubular opening accessible from the water box into which the high pressure fluid lance hose is to be inserted.

12. The apparatus according to claim 11 wherein the tractor drive module has a spur gear engaging notches in the top wall of the guide rail to propel the tractor drive module along the guide rail.

13. The apparatus according to claim 11 further comprising a hose take-up drum module mounted on the guide rail and spaced from the hose drive module operable to collect and dispense the flexible high pressure fluid lance hose from and to the hose drive module.

14. The apparatus according to claim 12 wherein the rotator module includes a tubular sleeve receiving a distal end of the flexible lance hose guide conduit, the arcuate right angle guide tube having one end axially aligned with the flexible lance hose guide conduit from the hose drive module, wherein the arcuate right angle guide tube is removable from the tubular sleeve and has an open end directed at an angle from the hose guide conduit axis, and a drive motor connected to the tubular sleeve for rotating the sleeve and the arcuate right angle guide tube about the distal end of the flexible lance hose guide conduit.

15. The apparatus according to claim 11 wherein the tractor drive module is rollably supported on the guide rail.

16. The apparatus according to claim 15 wherein the rotator module is rollably supported on the guide rail.

17. The apparatus according to claim 11 wherein each of the rotator and tractor drive modules are rollably supported on the guide rail by two rollers riding on one rib of the guide rail and one roller riding on a parallel rib of the guide rail.

* * * * *